US009445213B2

(12) United States Patent
Xiang et al.

(10) Patent No.: US 9,445,213 B2
(45) Date of Patent: Sep. 13, 2016

(54) SYSTEMS AND METHODS FOR PROVIDING SURROUND SOUND USING SPEAKERS AND HEADPHONES

(75) Inventors: Pei Xiang, San Diego, CA (US); Prajakt Kulkarni, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 622 days.

(21) Appl. No.: 12/479,472

(22) Filed: Jun. 5, 2009

(65) Prior Publication Data

US 2009/0304214 A1 Dec. 10, 2009

Related U.S. Application Data

(60) Provisional application No. 61/060,294, filed on Jun. 10, 2008.

(51) Int. Cl.
*H04R 5/02* (2006.01)
*H04S 7/00* (2006.01)

(52) U.S. Cl.
CPC ..... *H04S 7/30* (2013.01); *H04R 2205/024* (2013.01); *H04S 2400/01* (2013.01); *H04S 2400/07* (2013.01); *H04S 2420/01* (2013.01)

(58) Field of Classification Search
CPC .. H04S 7/30; H04S 2420/01; H04S 2400/07; H04S 2400/01; H04S 3/00; H04S 1/002; H04R 2205/024; H04R 5/02; H04R 2420/03
USPC ..... 381/307, 120, 309, 310, 300, 74, 1, 381/311, 370; 361/679.09, 679.3; 455/556.2, 3.06, 575.2, 3.01; 712/32, 712/1; 700/94
See application file for complete search history.

(56) References Cited

U.S. PATENT DOCUMENTS

| | | | | |
|---|---|---|---|---|
| 6,144,747 | A * | 11/2000 | Scofield et al. | 381/309 |
| 6,614,912 | B1 * | 9/2003 | Yamada et al. | 381/310 |
| 6,961,632 | B2 | 11/2005 | Hashimoto et al. | |
| 6,990,210 | B2 | 1/2006 | Cheng | |
| 7,050,596 | B2 * | 5/2006 | Cheng | 381/309 |
| 7,146,018 | B2 * | 12/2006 | Tamayama | 381/300 |

(Continued)

FOREIGN PATENT DOCUMENTS

| | | |
|---|---|---|
| CN | 1630434 A | 6/2005 |
| EP | 1545154 A2 | 6/2005 |

(Continued)

OTHER PUBLICATIONS

International Search Report and the Written Opinion—PCT/US2009/046765, International Search Authority—European Patent Office—Aug. 12, 2009.

(Continued)

*Primary Examiner* — Vivian Chin
*Assistant Examiner* — Con P Tran
(74) *Attorney, Agent, or Firm* — Espartaco Diaz Hidalgo

(57) ABSTRACT

A mobile device may include at least one processor configured to generate a first set and second set of processed audio signals for use in a surround sound system. The mobile device may also include at least one output port adapted to provide the first set of processed audio signals for use in the surround sound system to at least two speakers. The mobile device may also include an output port adapted to provide the second set of processed audio signals for use in the surround sound system to headphone speakers.

44 Claims, 16 Drawing Sheets

(56) References Cited

U.S. PATENT DOCUMENTS

| | | | | |
|---|---|---|---|---|
| 7,561,932 | B1 * | 7/2009 | Holmes et al. | 700/94 |
| 7,986,792 | B2 * | 7/2011 | Noro | 381/80 |
| 2002/0038158 | A1 | 3/2002 | Hashimoto et al. | |
| 2003/0099369 | A1 | 5/2003 | Cheng | |
| 2005/0107900 | A1 * | 5/2005 | Tseng et al. | 700/94 |
| 2005/0135643 | A1 | 6/2005 | Lee et al. | |
| 2006/0008094 | A1 * | 1/2006 | Huang et al. | 381/79 |
| 2006/0269068 | A1 * | 11/2006 | Yokota | 381/1 |
| 2006/0280323 | A1 * | 12/2006 | Neidich et al. | 381/300 |
| 2007/0087686 | A1 | 4/2007 | Holm et al. | |
| 2007/0183617 | A1 * | 8/2007 | Yokota et al. | 381/386 |
| 2008/0008324 | A1 * | 1/2008 | Sim et al. | 381/1 |

FOREIGN PATENT DOCUMENTS

| | | | |
|---|---|---|---|
| JP | 05095591 | A * | 4/1993 |
| JP | 07095696 | | 4/1995 |
| JP | 10013987 | A | 1/1998 |
| JP | 2001177609 | A | 6/2001 |
| JP | 2003199200 | A | 7/2003 |
| JP | 2008113118 | A | 5/2008 |
| JP | 2008522483 | A | 6/2008 |
| JP | 2009531886 | A | 9/2009 |
| KR | 20050060789 | A | 6/2005 |
| TW | I230024 | B | 3/2005 |
| TW | 200623936 | | 7/2006 |
| WO | 03079650 | A1 | 9/2003 |
| WO | 2006057521 | A1 | 6/2006 |
| WO | 2007110103 | A1 | 10/2007 |
| WO | 2009101622 | A2 | 8/2009 |

OTHER PUBLICATIONS

Taiwan Search Report—TW098119420—TIPO—Feb. 25, 2013.

* cited by examiner

SYSTEMS AND METHODS FOR PROVIDING SURROUND SOUND USING SPEAKERS AND HEADPHONES

RELATED APPLICATIONS

The present Application for Patent claims priority to Provisional Application No. 61/060,294, entitled "SYSTEMS AND METHODS FOR PROVIDING SURROUND SOUND USING SPEAKERS AND HEADPHONES" filed Jun. 10, 2008, and assigned to the assignee hereof and hereby expressly incorporated by reference herein.

TECHNICAL FIELD

The present disclosure relates generally to audio processing. More specifically, the present disclosure relates to surround sound technology.

BACKGROUND

As used herein, the term "surround sound" refers generally to the production of sound in such a way that a listener perceives sound coming from multiple directions. Multiple audio channels may be used to create surround sound. Different audio channels may be intended to be perceived as coming from different directions, such as in front of the listener, in back of the listener, to the side of the listener, etc.

As used herein, the term "front audio channel" refers generally to an audio channel that is intended to be perceived as coming from a location that is somewhere in front of the listener. The term "surround audio channel" refers generally to an audio channel that is intended to be perceived as coming from a location that is somewhere in back of the listener. The term "surround side audio channel" refers generally to an audio channel that is intended to be perceived as coming from a location that is somewhere to the side of the listener.

One example of a surround sound configuration is 5.1 surround sound. With 5.1 surround sound, there may be five audio channels and one low frequency effects channel. The five audio channels may include three front audio channels (a left audio channel, a right audio channel, and a center audio channel) and two surround audio channels (a left surround audio channel and a right surround audio channel).

Another example of a surround sound configuration is 7.1 surround sound. With 7.1 surround sound, there may be seven audio channels and one low frequency effects channel. The seven audio channels may include three front audio channels (a left audio channel, a right audio channel, and a center audio channel), two surround audio channels (a left surround audio channel and a right surround audio channel), and two surround side audio channels (a left surround side audio channel and a right surround side audio channel).

There are many other possible configurations for surround sound. Some examples of other known surround sound configurations include 3.0 surround sound, 4.0 surround sound, 6.1 surround sound, 10.2 surround sound, 22.2 surround sound, etc.

As indicated above, the present disclosure relates generally to surround sound technology. More specifically, the present disclosure relates to improvements in the way that surround sound may be implemented.

DETAILED DESCRIPTION

Figure 1:
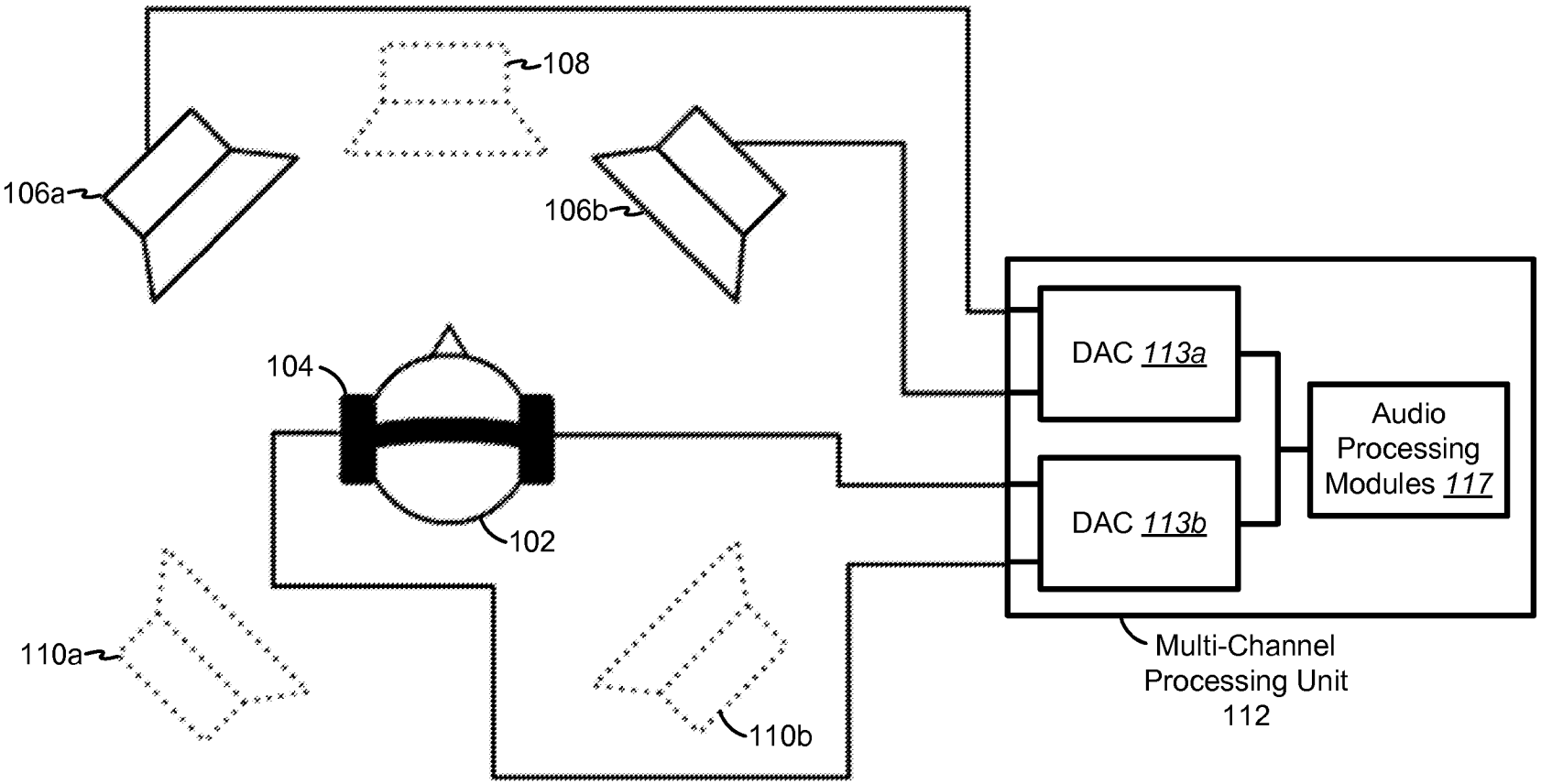
FIG. 1 illustrates an example showing how a listener may experience surround sound in accordance with the present disclosure.

A mobile device is disclosed. A method for providing surround sound using speakers and headphones is also disclosed. The method may include producing a first set and second set of processed audio signals for use in a surround sound system. The method may also include having at least two speakers play the first set of processed audio signals for use in the surround sound system. The method may also include having headphones play the second set of processed audio signals for use in the surround sound system.

Another mobile device is also disclosed. The mobile device may include means for generating a first set and second set of processed audio signals for use in a surround sound system. The mobile device may also include means for providing the first set of processed audio signals for use in the surround sound system to at least two speakers. The mobile device may also include means for providing the second set of processed audio signals for use in the surround sound system to headphone speakers.

A computer-readable medium comprising instructions for providing surround sound using speakers and headphones is also disclosed. When executed by a processor, the instructions cause the processor to generate a first set and second set of processed audio signals for use in a surround sound system. The instructions also cause the processor to provide the first set of processed audio signals for use in the surround sound system to at least two speakers. The instructions also cause the processor to provide the second set of processed audio signals for use in the surround sound system to headphone speakers.

An integrated circuit for providing surround sound using speakers and headphones is also disclosed. The integrated circuit may configured to generate a first set and second set of processed audio signals for use in a surround sound system. The integrated circuit may also be configured to provide the first set of processed audio signals for use in the surround sound system to at least two speakers. The integrated circuit may also be configured to provide the second set of processed audio signals for use in the surround sound system to headphone speakers.

As indicated above, the present disclosure relates to improvements in the way that surround sound may be implemented. In accordance with the present disclosure, both stereo speakers and headphones may be used simultaneously to provide surround sound for a listener.

For example, to implement a 5.1 surround sound configuration, front audio channels (e.g., left, right, and center channels) may be produced in speaker channels that are output via left and right speakers. Surround audio channels (e.g., left and right surround channels) and the low frequency effects channel may be produced in headphone channels that are output via headphones.

As another example, to implement a 7.1 surround sound configuration, front audio channels (e.g., left, right, and center channels) may be produced in the speaker channels. Surround audio channels (e.g., left and right surround channels) and the low frequency effects channel may be produced in the headphone channels. Surround side audio channels (e.g., left and right surround side channels) may be partially produced in the speaker channels and partially produced in the headphone channels.

The examples just described should not be interpreted as limiting the scope of the present disclosure. The 5.1 and 7.1 surround sound configurations may be achieved in a variety of different ways using the techniques described herein. In addition, although the present disclosure includes discussions of 5.1 and 7.1 surround sound configurations, this is for purposes of example only. The techniques described herein may be applied to any surround sound configuration, including 3.0 surround sound, 4.0 surround sound, 6.1 surround sound, 10.2 surround sound, 22.2 surround sound, etc. The present disclosure is not limited to any particular surround sound configuration or to any set of surround sound configurations.

The present disclosure may be applicable to mobile devices. In other words, the techniques described herein may be implemented in mobile devices. By implementing surround sound using a combination of speakers and headphones, the present disclosure may provide a convenient and effective way for a user of a mobile device to experience surround sound.

As used herein, the term "mobile device" should be interpreted broadly to encompass any type of computing device that may be conveniently carried by a user from one place to another. Some examples of mobile devices include laptop computers, notebook computers, cellular telephones, wireless communication devices, personal digital assistants (PDAs), smart phones, portable media players, handheld game consoles, smart phones, iPods, MP3 players, media players, and a wide variety of other consumer devices, electronic book readers, etc.

The mobile device may include at least one processor configured to generate a first set and second set of processed audio signals for use in a surround sound system. The mobile device may also include at least one output port adapted to provide the first set of processed audio signals for use in the surround sound system to at least two speakers. The mobile device may also include an output port adapted to provide the second set of processed audio signals for use in the surround sound system to headphone speakers.

FIG. 1 illustrates one way that a listener 102 may experience surround sound in accordance with the present disclosure. The listener 102 is shown wearing headphones 104. In addition, left and right stereo speakers 106*a-b* are positioned in front of the listener 102.

As indicated above, with 5.1 surround sound there are five audio channels and one low-frequency effects channel. The five audio channels are a left channel, a right channel, a center channel, a left surround channel, and a right surround channel.

For the listener 102 to experience 5.1 surround sound, the left channel may be routed to the left speaker 106*a*. The right channel may be routed to the right speaker 106*b*. The center channel may be virtualized through the left and right speakers 106*a-b*. The left and right surround channels may be virtualized through the headphones 104. A virtual center speaker 108 and virtual left and right surround speakers 110*a-b*, are shown in FIG. 1 to represent the virtualization of the center channel and the left and right surround channels, respectively.

FIG. 1 also shows a multi-channel processing unit 112. The multi-channel processing unit 112 may be configured to drive the speakers 106*a-b* and the headphones 104, respectively. The multi-channel processing unit 112 may include various audio processing modules 117, which will be described in greater detail below. The multi-channel processing unit 112 may also include a digital-to-analog converter (DAC) 113*a* for the speakers 106*a-b* and a DAC 113*b* for the headphones 104, as shown.

The multi-channel processing unit 112 may be implemented within a mobile device. Under some circumstances, the multi-channel processing unit 112 may be implemented within a handset (which may be a mobile device) that communicates with a headset (which may include the headphones 104). Alternatively, at least some aspects of the multi-channel processing unit 112 may be implemented within a headset.

In some implementations, the headphones 104 may be bone-conduction headphones instead of conventional acoustic ones (e.g., in-ear, around-ear, on-ear, etc.), which are well-known in the art. With bone-conduction headphones, sound vibrations are transmitted through skin, cartilage, and then skull, into the inner ear. Despite a different flavor of frequency response, bone-conduction headphones still fulfill the task of generating nice rear sound image through aforementioned headphone technologies. One example of a bone conduction speaker is a rubber over-moulded piezo-electric flexing disc about 40 mm across and 6 mm thick used by SCUBA divers. The connecting cable is moulded into the disc, resulting in a tough, water-proof assembly. In use the speaker is strapped against one of the dome-shaped bone protrusion behind the ear. As would be expected, the sound produced seems to come from inside the user's head, but can be surprisingly clear and crisp. With bone-conduction headphones, the user's ears are no longer occupied by a conventional acoustic headphone. This results in a better perception of the front speaker channels through air. Thus, a headphone speaker may be a bone-conduction headphone speaker, an in-ear headphone speaker, an around-ear headphone speaker, an on-ear headphone speaker, or any other type of headphone speaker that will allow a user to hear sound.

In some implementations, the headphones 104 may include a DAC. This may be the case, for example, if the headphones include a Bluetooth® communication interface and are configured to operate in accordance with the Bluetooth® protocol. In such implementations, digital audio data may be sent to the headphones 104 through a wireless channel (e.g., using the Advanced Audio Distribution Profile (A2DP) protocol), and the DAC to convert the digital audio data to analog data may reside in the headphones 104. Thus, in this type of implementation, the multi-channel processing unit 112 may not include a DAC 113*b* for the headphones 104, since the DAC in the headphones 104 could be leveraged. This type of implementation is shown in FIG. 1B, and will be discussed below.

Figure 1A:
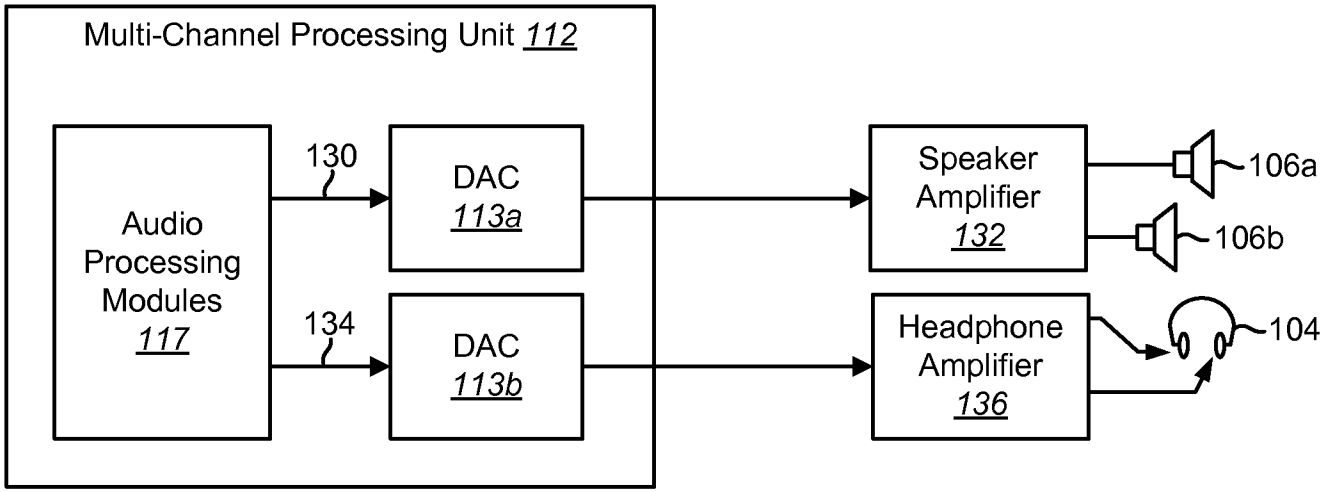
FIG. 1A illustrates certain aspects of one possible implementation of a multi-channel processing unit.

FIG. 1A shows the audio processing modules 117 of the multi-channel processing unit 112 producing speaker channels 130 and headphone channels 134. The multi-channel processing unit 112 may include DACs 113*a-b* for performing digital-to-analog conversion for both the speaker channels 130 and the headphone channels 134. The DAC 113*a* that performs digital-to-analog conversion for the speaker channels 130 is shown in electronic communication with an amplifier 132 for the speakers 106*a-b*. The DAC 113*b* that performs digital-to-analog conversion for the headphone channels 134 is shown in electronic communication with an amplifier 136 for the headphones 104.

Figure 1B:
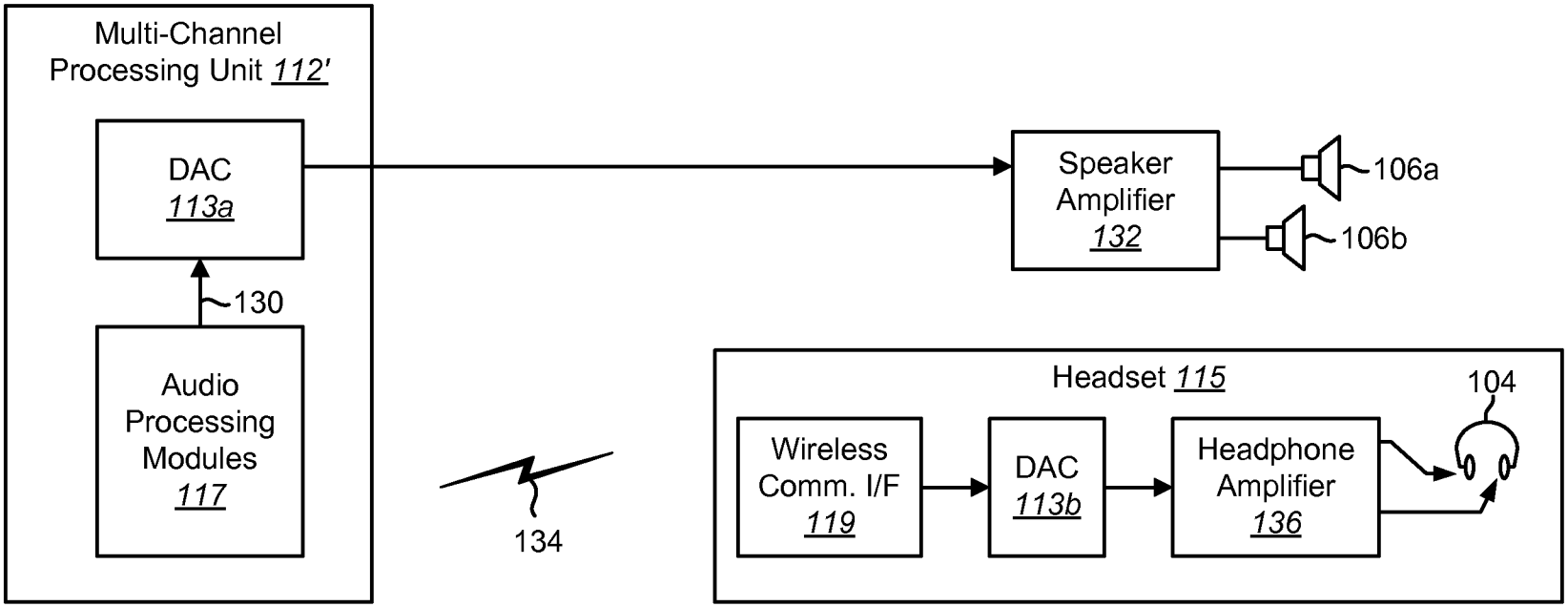
FIG. 1B illustrates certain aspects of another possible implementation of a multi-channel processing unit.

An alternative implementation is illustrated in FIG. 1B, where a multi-channel processing unit 112' is shown. Audio processing modules 117 of the multi-channel processing unit 112' may produce speaker channels 130 and headphone channels 134. The multi-channel processing unit 112' may include a DAC 113*a* for performing digital-to-analog conversion for the speaker channels 130. This DAC 113*a* is shown in electronic communication with an amplifier 132 for the speakers 106*a-b*. The headphone channels 134 (as digital data) may be sent to a headset 115 through a wireless channel, and the DAC 113*b* to convert the digital audio data to analog data may reside in the headset 115. This DAC 113*b* is shown in electronic communication with an amplifier 136 for the headphones 104.

Communication between the multi-channel processing unit 112' and the headset 115 may occur via a wireless link, as shown in FIG. 1B. The headset 115 is also shown with a wireless communication interface 119 for receiving wireless communication from the multi-channel processing unit 112' via the wireless link. There are a variety of different wireless communication protocols that may facilitate wireless communication between the multi-channel processing unit 112' and the headset 115. For example, communication between the multi-channel processing unit 112' and the headset 115 may occur in accordance with a Bluetooth® protocol, an Institute of Electrical and Electronics Engineers wireless communication protocol (e.g., 802.11x, 802.15x, 802.16x, etc.), or the like.

Figure 2:
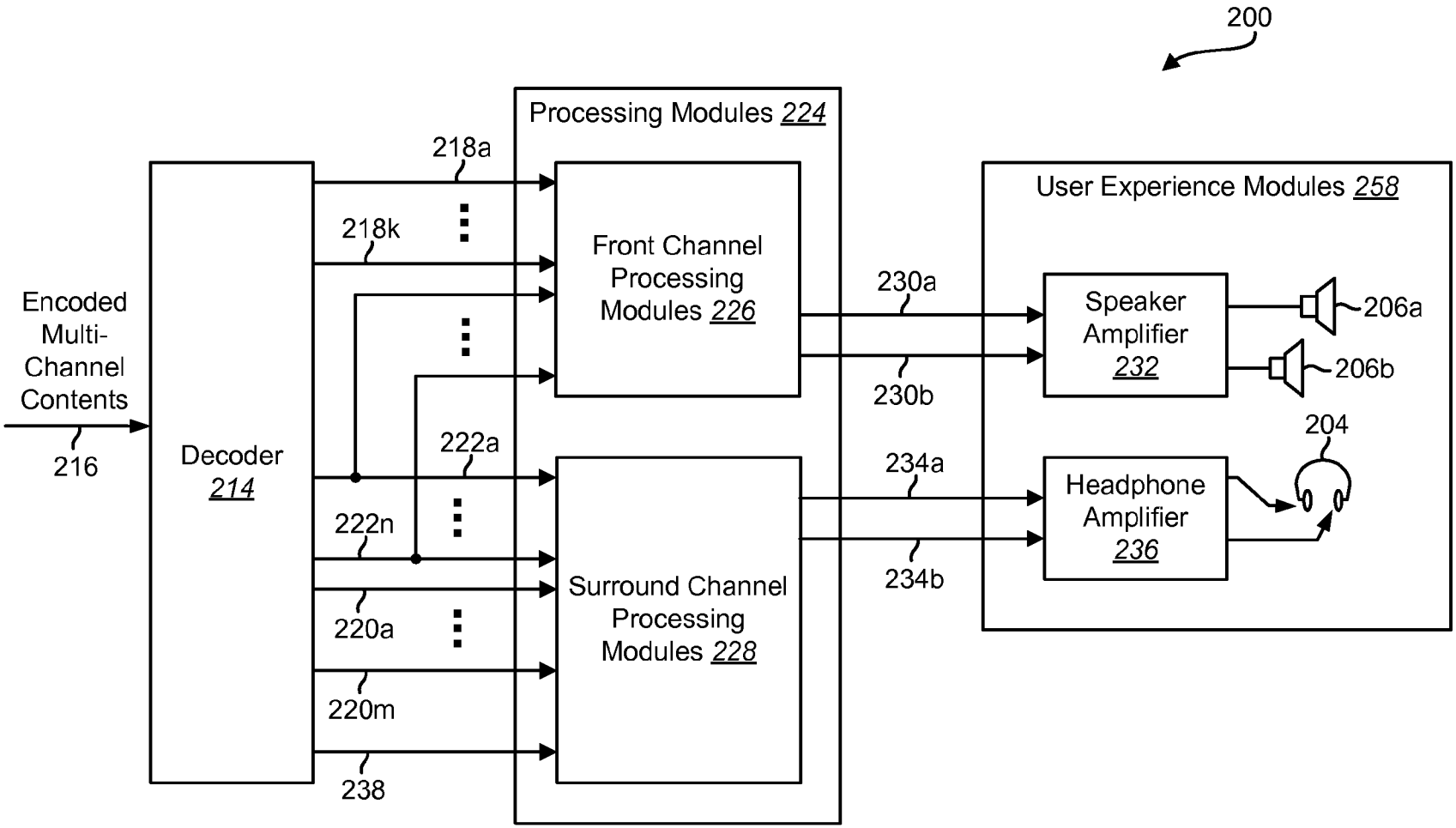
FIG. 2 illustrates a system for providing surround sound using speakers and headphones.

FIG. 2 illustrates a system 200 for providing surround sound using speakers 206 and headphones 204. A decoder 214 may receive encoded multi-channel contents 216 as input. The encoded multi-channel contents 216 may be encoded in accordance with any format that provides surround sound, such as AC3, Digital Theater System (DTS), Windows® Media Audio (WMA), Moving Picture Experts Group (MPEG) Surround, etc. The decoder 214 may output k front audio channels 218*a* . . . 218*k, m* surround audio channels 220*a* . . . 220*m, n* surround side audio channels 222*a* . . . 222*n*, and a low frequency effects channel 238.

The front audio channels 218, the surround audio channels 220, the surround side audio channels 222, and the low frequency effects channel 238 may be provided as input to processing modules 224. The processing modules 224 may include front channel processing modules 226 and surround channel processing modules 228.

The front audio channels 218 may be provided as input to the front channel processing modules 226. The front channel processing modules 226 may process the audio signals in the front audio channels 218 so that the front audio channels 218 are produced in left and right speaker channels 230*a-b*.

The surround audio channels 220 and the low frequency effects channel 238 may be provided as input to the surround channel processing modules 228. The surround channel processing modules 228 may process the audio signals in the surround audio channels 220 and the low frequency effects channel 238 so that the surround audio channels 220 and the low frequency effects channel 238 are produced in left and right headphone channels 234*a-b*.

The surround side audio channels 222 may be provided as input to both the front channel processing modules 226 and the surround channel processing modules 228. The front channel processing modules 226 may process the audio signals in the surround side audio channels 222 so that the surround side audio channels 222 are partially produced in the speaker channels 230*a-b*. The surround channel processing modules 228 may process the audio signals in the surround side audio channels 222 so that the surround side audio channels 222 are partially produced in the headphone channels 234*a-b*.

The speaker channels 230*a-b* and the headphone channels 234*a-b* may be provided as input to user experience modules 258. The user experience modules 258 may include a speaker amplifier 232 for driving left and right stereo speakers 206*a-b*. The speaker channels 230*a-b* may be provided to the speaker amplifier 232 as input. The user experience modules 258 may also include a headphone amplifier 236 for driving headphones 204. The headphone channels 234*a-b* may be provided to the headphone amplifier 236 as input.

The decoder 214 and the processing modules 224 are examples of audio processing modules 117 that may be implemented in a multi-channel processing unit 112, as was discussed above in relation to FIG. 1. As discussed above, the multi-channel processing unit 112 may include digital-to-analog converters (DACs) 113*a-b* for the speakers 206*a-b* and the headphones 204, respectively. Alternatively, the headphones 204 may include a DAC, and the multi-channel processing unit 112 may not include a DAC 113*b* for the headphones 104.

Figure 3:
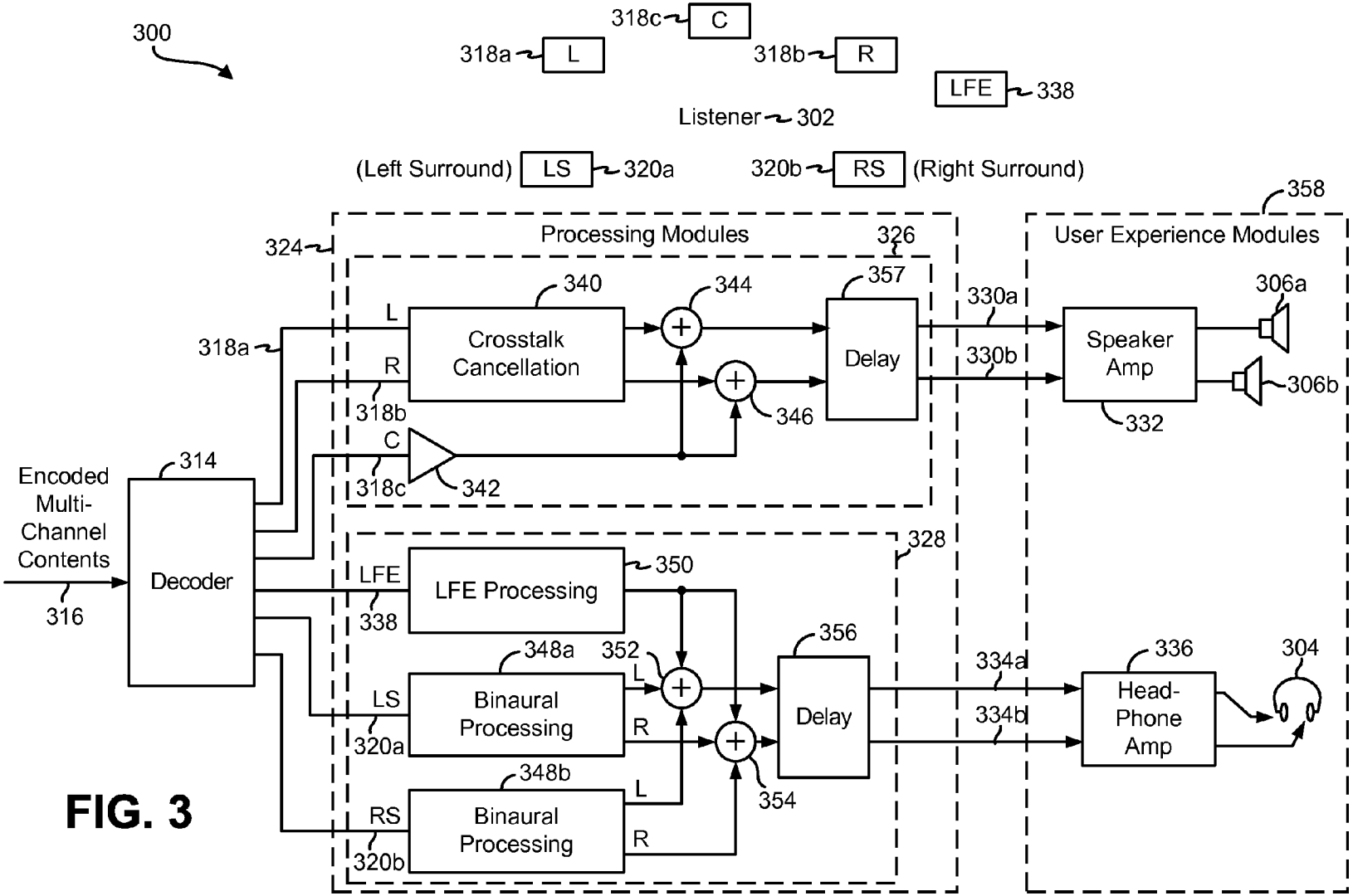
FIG. 3 illustrates another system for providing surround sound using speakers and headphones.

FIG. 3 illustrates another system 300 for providing surround sound using speakers 306 and headphones 304. The depicted system 300 may be used to implement a 5.1 surround sound configuration.

As indicated above, with 5.1 surround sound there may be three front audio channels 318, two surround audio channels 320, and one low frequency effects channel 338. The three front audio channels 318 may be a left audio channel 318*a*, a right audio channel 318*b*, and a center audio channel 318*c*. The two surround audio channels 320 may be a left surround audio channel 320*a* and a right surround audio channel 320*b*. The top part of FIG. 3 shows how the front audio channels 318, the surround audio channels 320, and the low frequency effects channel 338 may be perceived by a listener 302.

A decoder 314 may receive encoded multi-channel contents 316 as input. The decoder 314 may output front audio channels 318, namely a left audio channel 318*a* (L), a right audio channel 318*b* (R), and a center audio channel 318*c* (C). The decoder 314 may also output surround audio channels 320, namely a left surround audio channel 320*a*

(LS) and a right surround audio channel 320*b* (RS). The decoder 314 may also output a low frequency effects channel 338 (LFE).

The front audio channels 318, the surround audio channels 320, and the low frequency effects channel 338 may be provided as input to processing modules 324. The processing modules 324 may include front channel processing modules 326 and surround channel processing modules 328.

The front audio channels 318 may be provided as input to the front channel processing modules 326. The front channel processing modules 326 may process the audio signals in the front audio channels 318 so that the front audio channels 318 are produced in left and right stereo speaker channels 330*a-b*.

The front channel processing modules 326 may include a crosstalk cancellation component 340. The crosstalk cancellation component 340 may process the audio signals in the left audio channel 318*a* and the right audio channel 318*b* for crosstalk cancellation. In the context of the present disclosure, the term "crosstalk" may refer to the left audio channel 318*a*, which was intended to be heard by the listener's left ear, having an acoustic path to the listener's right ear (or vice versa, i.e., the right audio channel 318*b*, which was intended to be heard by the listener's right ear, having an acoustic path to the listener's left ear). Crosstalk cancellation refers to techniques for limiting the effects of crosstalk.

The front channel processing modules 326 may also include an attenuator 342. The attenuator 342 may attenuate the center audio channel 318*c* by some predetermined factor (e.g., $1/\sqrt{2}$).

The front channel processing modules 326 may also include an adder 344 that adds the output of the attenuator 342 and the output of the crosstalk cancellation component 340 that corresponds to the left audio channel 318*a*. The front channel processing modules 326 may also include an adder 346 that adds the output of the attenuator 342 and the output of the crosstalk cancellation component 340 that corresponds to the right audio channel 318*b*. The left and right stereo speaker channels 330*a-b* may be output from the adders 344, 346. The delay component 357 may introduce a delay into the speaker channel path to compensate for the transmissional delay between the speaker channel processing module 328 and the left and right headphone channels 334*a-b*.

The surround audio channels 320 and the low frequency effects channel 338 may be provided as input to the surround channel processing modules 328. The surround channel processing modules 328 may process the audio signals in the surround audio channels 320 and the low frequency effects channel 338 so that the surround audio channels 320 and the low frequency effects channel 338 are produced in left and right headphone channels 334*a-b*.

The surround channel processing modules 328 may include first and second binaural processing components 348*a-b*. The first binaural processing component 348*a* may perform binaural processing on the audio signals in the left surround audio channel 320*a*. The second binaural processing component 348*b* may perform binaural processing on the audio signals in the right surround audio channel 320*b*. For example, techniques using head-related transfer functions (HRTFs) may be utilized.

The surround channel processing modules 328 may also include a component 350 that performs filtering, gain adjustment, and possibly other adjustments with respect to the low frequency effects channel 338. This component 350 may be referred to as a low frequency effects processing component 350. The surround channel processing modules 328 may also include adders 352, 354 that may add the outputs of the binaural processing components 348 and the output of the low frequency effects processing component 350.

The surround channel processing modules 328 may also include a delay component 356. The delay component 356 may introduce a delay into the headphone channel path in order to compensate for an acoustic delay from the stereo speakers 306*a-b* to the ears of the listener 302, and/or the delay component 356 may compensate for the transmission delay (e.g., bluetooth, wireless audio, etc.) from the front channel processing module to the speaker amp 332. The headphone channels 334*a-b* may be output from the delay component 356. The delay component 356 may also be configurable. If the total delay in the speaker channel path is longer than that of the headphone channel path, then delay component 357 may not need to be enabled. Similarly, if the total delay in the headphone channel path is longer than that of the speaker channel path, then delay component 356 may not need to be enabled.

The speaker channels 330*a-b* and the headphone channels 334*a-b* may be provided as input to user experience modules 358. The user experience modules 358 may include a speaker amplifier 332 for driving left and right stereo speakers 306*a-b*. The speaker channels 330*a-b* may be provided to the speaker amplifier 332 as input. The user experience modules 358 may also include a headphone amplifier 336 for driving headphones 304. The headphone channels 334*a-b* may be provided to the headphone amplifier 336 as input.

The decoder 314 and the processing modules 324 are examples of audio processing modules 117 that may be implemented in a multi-channel processing unit 112, as was discussed above in relation to FIG. 1. As discussed above, the multi-channel processing unit 112 may include digital-to-analog converters (DACs) 113*a-b* for the speakers 306*a-b* and the headphones 304, respectively. Alternatively, the headphones 304 may include a DAC, and the multi-channel processing unit 112 may not include a DAC 113*b* for the headphones 104.

For clarity of illustration, delay component 357 is not explicitly shown in FIGS. 3A, 3B, 3C, and 4. However, they may be located as shown in FIG. 3, and may operate as discussed previously.

Figure 3A:
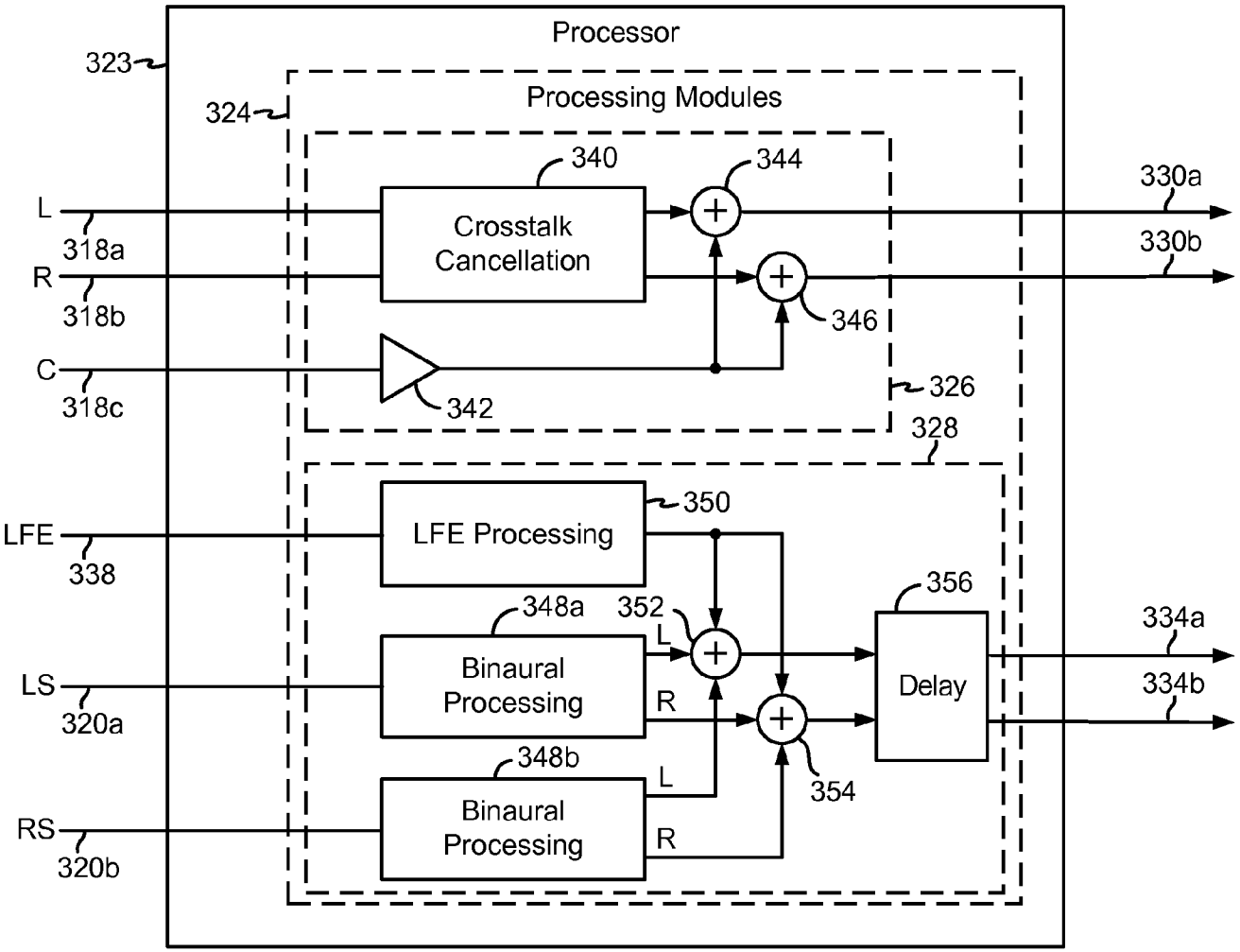
FIG. 3A illustrates one possible implementation of certain components in the system of FIG. 3.
Figure 3B:
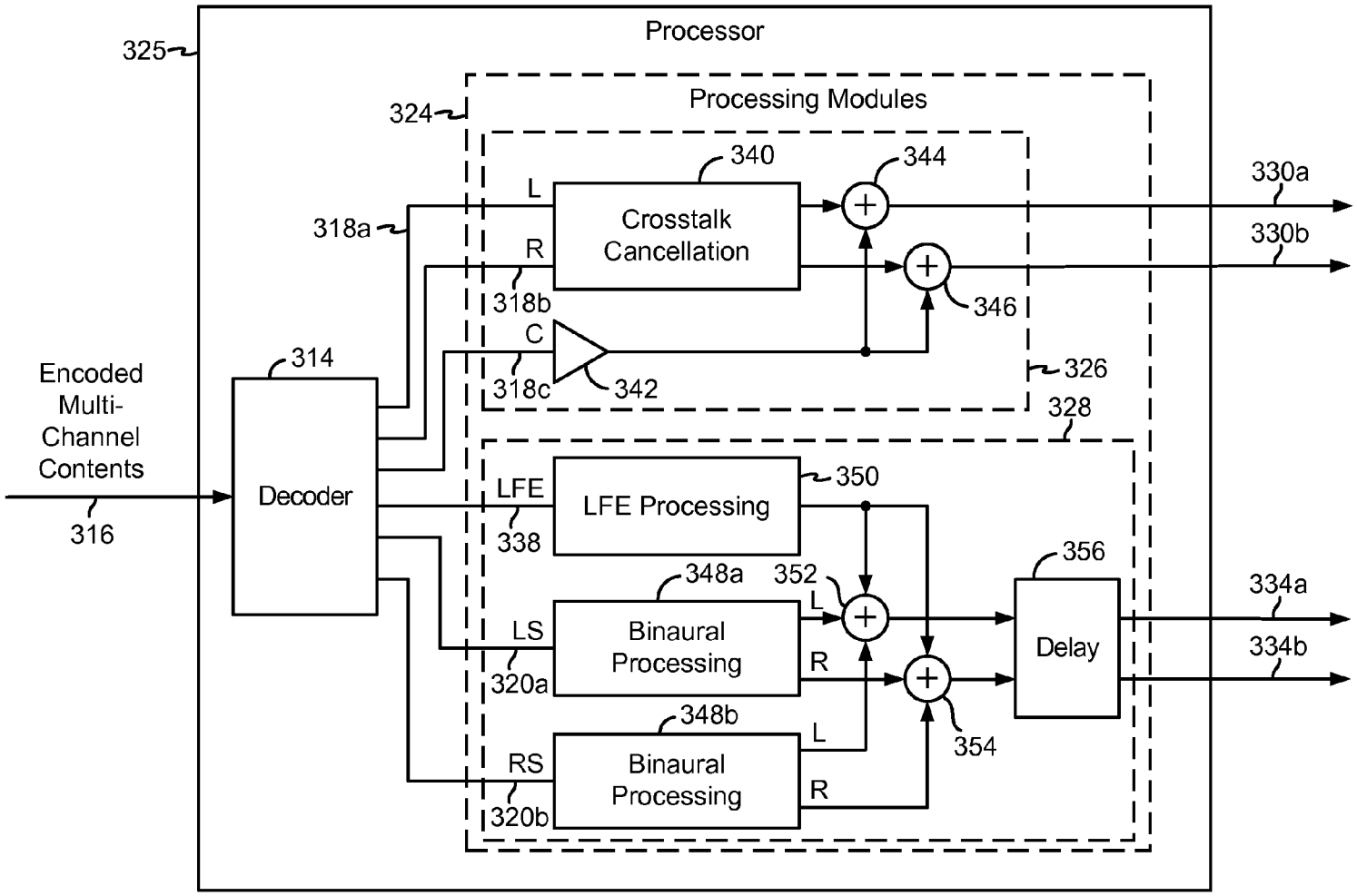
FIG. 3B illustrates another possible implementation of certain components in the system of FIG. 3.
Figure 3C:
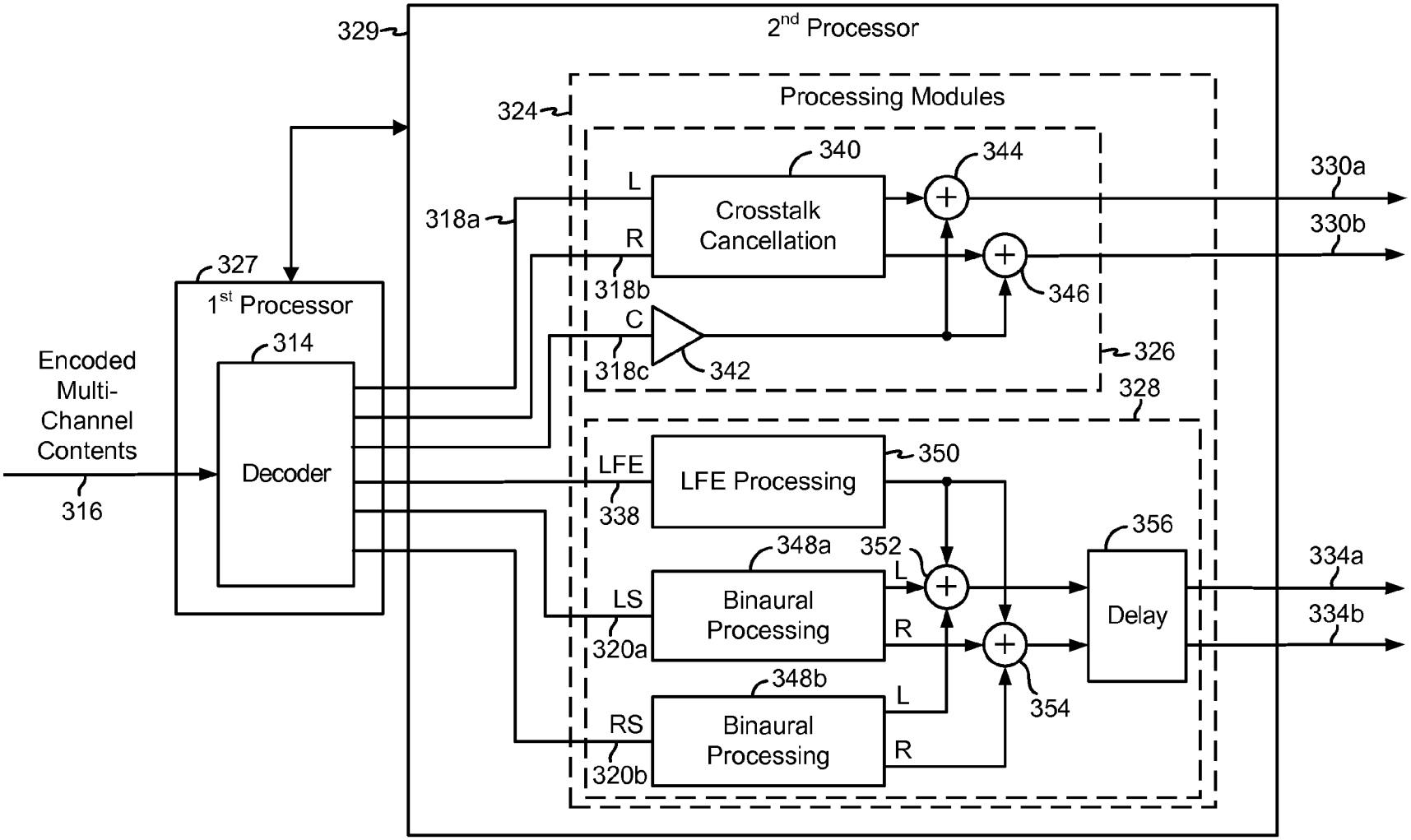
FIG. 3C illustrates another possible implementation of certain components in the system of FIG. 3.

Referring to FIG. 3A, the processing modules 324, including the front channel processing modules 326 and the surround channel processing modules 328, may be implemented in a processor 323. Alternatively, as shown in FIG. 3B, both the decoder 314 and the processing modules 324 may be implemented in a processor 325. Alternatively, the decoder 314 and/or the processing modules 324 may be implemented across multiple processors. For example, referring to FIG. 3C, the decoder 314 may be implemented in a first processor 327, and the processing modules 324 may be implemented in a second processor 329.

The first processor 327 and the second processor 329 may be implemented on the same device or on different devices. For example, the decoder 314 could be part of a DVD player or some other device that decodes the encoded multi-channel contents 318, and the processor 329 encompassing the processing modules 324 could be located on a mobile device.

As used herein, the term "processor" may refer to any general purpose single- or multi-chip microprocessor, such as an ARM, or any special purpose microprocessor such as a digital signal processor (DSP), a microcontroller, a programmable gate array, etc. In some configurations, a combination of processors (e.g., an ARM and DSP) could be used to perform the functions in the processing modules 324.

Figure 4:
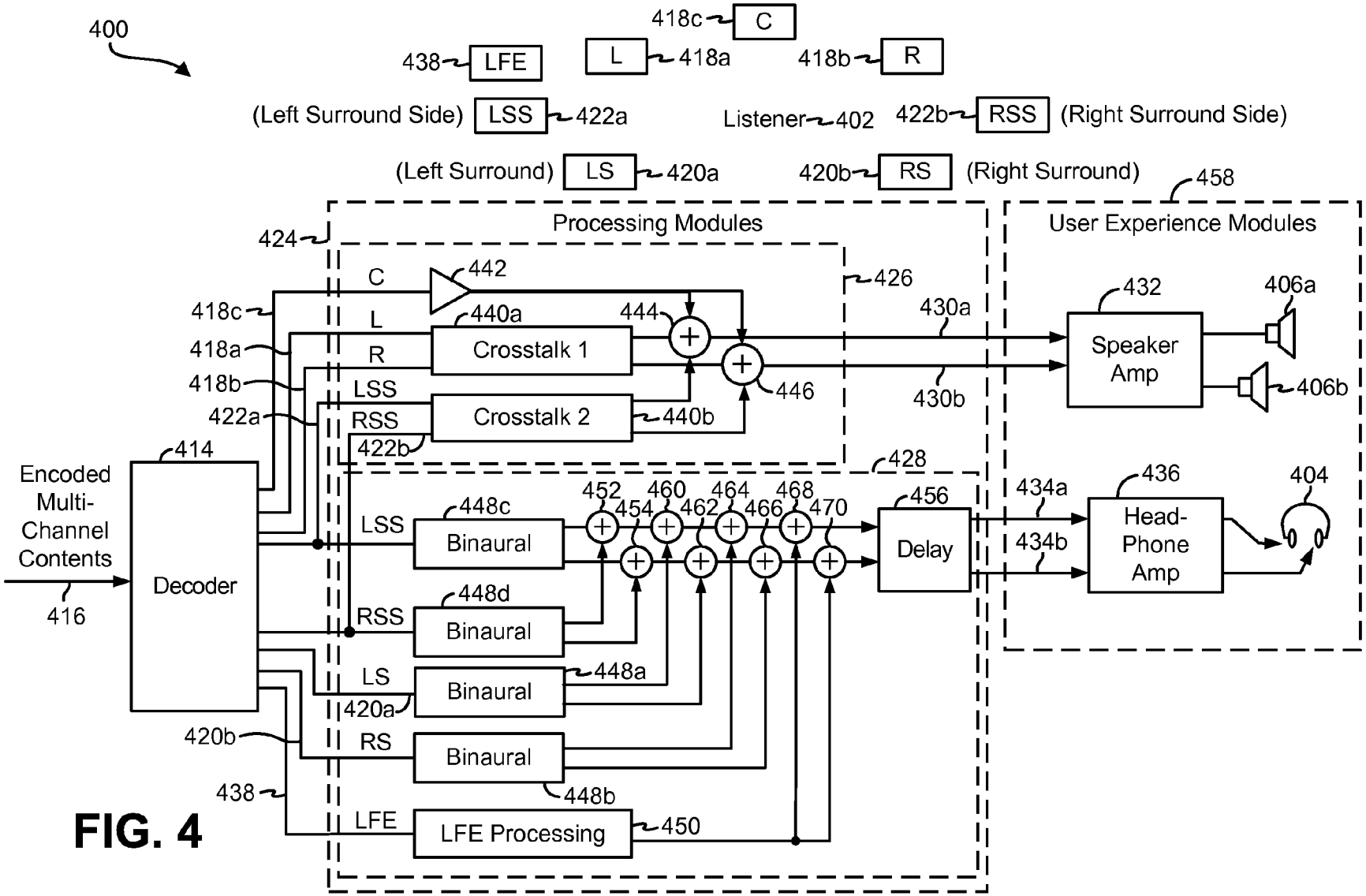
FIG. 4 illustrates another system for providing surround sound using speakers and headphones.

FIG. 4 illustrates another system 400 for providing surround sound using speakers 406 and headphones 404. The depicted system 400 may implement a 7.1 surround sound configuration.

As indicated above, with 7.1 surround sound there may be three front audio channels 418, two surround audio channels 420, two surround side audio channels 422, and one low frequency effects channel 438. The three front audio channels 418 may be a left audio channel 418*a*, a right audio channel 418*b*, and a center audio channel 418*c*. The two surround audio channels 420 may be a left surround audio channel 420*a* and a right surround audio channel 420*b*. The two surround side audio channels 422 may be a left surround side audio channel 422*a* and a right surround side audio channel 422*b*. The top part of FIG. 4 shows how the front audio channels 418, the surround audio channels 420, the surround side audio channels 422, and the low frequency effects channel 438 may be perceived by a listener 402.

A decoder 414 may receive encoded multi-channel contents 416 as input. The decoder 414 may output front audio channels 418, namely a left audio channel 418*a* (L), a right audio channel 418*b* (R), and a center audio channel 418*c* (C). The decoder 414 may also output surround audio channels 420, namely a left surround audio channel 420*a* (LS) and a right surround audio channel 420*b* (RS). The decoder 414 may also output surround side audio channels 422, namely a left surround side audio channel 422*a* (LSS) and a right surround side audio channel 422*b* (RSS). The decoder 414 may also output a low frequency effects channel 438 (LFE).

The front audio channels 418, the surround audio channels 420, the surround side audio channels 422, and the low frequency effects channel 438 may be provided as input to processing modules 424. The processing modules 424 may include front channel processing modules 426 and surround channel processing modules 428.

The front audio channels 418 may be provided as input to the front channel processing modules 426. The front channel processing modules 426 may process the audio signals in the front audio channels 418 so that the front audio channels 418 are produced in left and right stereo speaker channels 430*a-b*.

The surround side audio channels 422 may also be provided as input to the front channel processing modules 426. The front channel processing modules 426 may process the audio signals in the surround side audio channels 422 so that the surround side audio channels 422 are partially produced in the speaker channels 430*a-b*.

The front channel processing modules 426 may include first and second crosstalk cancellation components 440*a-b*. The first crosstalk cancellation component 440*a* may process the audio signals in the left audio channel 418*a* and the right audio channel 418*b* for crosstalk cancellation. The second crosstalk cancellation component 440*b* may process the audio signals in the left surround side audio channel 422*a* and the right surround side audio channel 422*b* for crosstalk cancellation.

The front channel processing modules 426 may also include an attenuator 442. The attenuator 442 may attenuate the center audio channel 418*c* by some predetermined factor (e.g., $1/\sqrt{2}$).

The front channel processing modules 426 may also include an adder 444 that adds the output of the attenuator 442, the left channel output of the first crosstalk cancellation component 440*a*, and the left channel output of the second crosstalk cancellation component 440*b*. The front channel processing modules 426 may also include an adder 446 that adds the output of the attenuator 442, the right channel output of the first crosstalk cancellation component 440*a*, and the right channel output of the second crosstalk cancellation component 440*b*. The left and right speaker channels 430*a-b* may be output from the adders 444, 446.

The surround audio channels 420 and the low frequency effects channel 438 may be provided as input to the surround channel processing modules 428. The surround channel processing modules 428 may process the audio signals in the surround audio channels 420 and the low frequency effects channel 438 so that the surround audio channels 420 and the low frequency effects channel 438 are produced in left and right headphone channels 434*a-b*.

The surround side audio channels 422 may also be provided as input to the surround channel processing modules 428. The surround channel processing modules 428 may process the audio signals in the surround side audio channels 422 so that the surround side audio channels 422 are partially produced in the headphone channels 434*a-b*.

The surround channel processing modules 428 may include several binaural processing components 448. A first binaural processing component 448*a* may perform binaural processing on the audio signals in the left surround audio channel 420*a*. A second binaural processing component 448*b* may perform binaural processing on the audio signals in the right surround audio channel 420*b*. A third binaural processing component 448*c* may perform binaural processing on the audio signals in the left surround side audio channel 422*a*. A fourth binaural processing component 448*d* may perform binaural processing on the audio signals in the right surround side audio channel 422*b*.

The surround channel processing modules 428 may also include a component 450 that performs filtering, gain adjustment, and possibly other adjustments with respect to the low frequency effects channel 438. This component 450 may be referred to as a low frequency effects processing component 450. The surround channel processing modules 428 may also include adders 452, 454, 460, 462, 464, 466, 468, 470 that may add the outputs of the binaural processing components 448 and the output of the low frequency effects processing component 450.

The surround channel processing modules 428 may also include a delay component 456. The delay component 456 may introduce a delay into the headphone channel path in order to compensate for an acoustic delay from the stereo speakers 406*a-b* to the ears of the listener 402. The headphone channels 434*a-b* may be output from the delay component 456.

The speaker channels 430*a-b* and the headphone channels 434*a-b* may be provided as input to user experience modules 458. The user experience modules 458 may include a speaker amplifier 432 for driving left and right stereo speakers 406*a-b*. The speaker channels 430*a-b* may be provided to the speaker amplifier 432 as input. The user experience modules 458 may also include a headphone amplifier 436 for driving headphones 404. The headphone channels 434*a-b* may be provided to the headphone amplifier 436 as input.

The decoder 414 and the processing modules 424 are examples of audio processing modules 117 that may be implemented in a multi-channel processing unit 112, as was discussed above in relation to FIG. 1. As discussed above, the multi-channel processing unit 112 may include digital-to-analog converters (DACs) 113*a-b* for the speakers 406*a-b* and the headphones 404, respectively. Alternatively, the headphones 404 may include a DAC, and the multi-channel processing unit 112 may not include a DAC 113*b* for the headphones 104.

Figure 5:
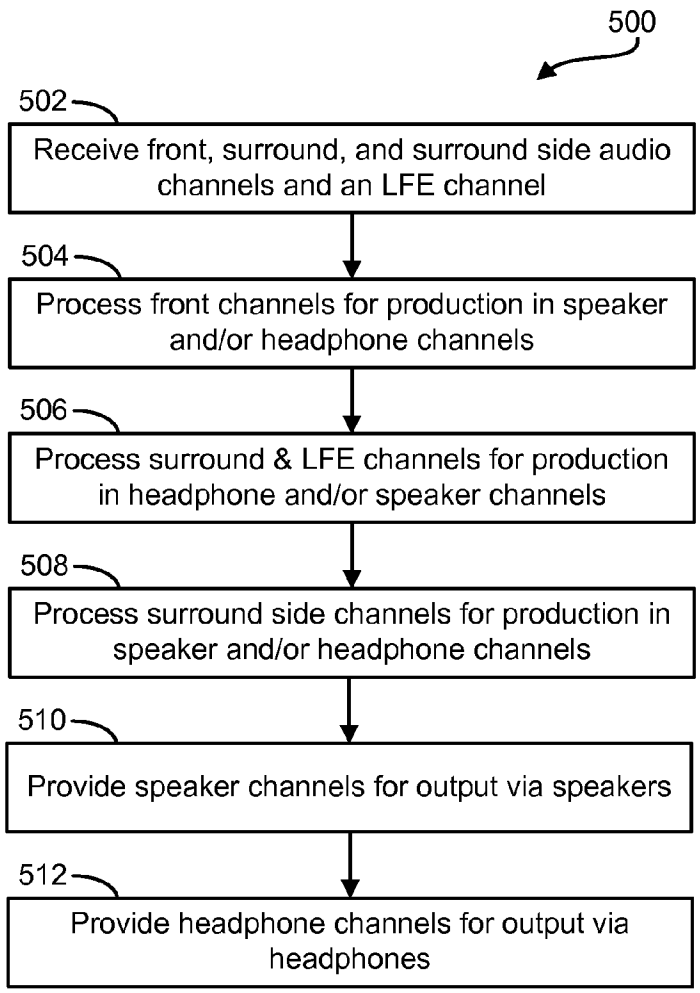
FIG. 5 illustrates a method for providing surround sound using speakers and headphones.

FIG. 5 illustrates a method 500 for providing surround sound using speakers 206 and headphones 204. In accordance with the method 500, k front audio channels 218*a* . . . 218*k, m* surround audio channels 220*a* . . . 220*m, n* surround side audio channels 222*a* . . . 222*n*, and a low frequency effects channel 238 may be received 502 from a decoder 214.

The audio signals in the front audio channels 218 may be processed 504 so that the front audio channels 218 are produced in speaker channels 230*a-b* and/or headphone channels 234*a-b*. The front audio channels 218 may produced solely in the speaker channels 230*a-b*, but the scope of the present disclosure should not be limited in this way.

The audio signals in the surround audio channels 220 and the low frequency effects channel 238 may be processed 506 so that the surround audio channels 220 and the low frequency effects channel 238 are produced in headphone channels 234*a-b* and/or speaker channels 230*a-b*. The surround audio channels 220 and the low frequency effects channel 238 may be produced solely in the headphone channels 234*a-b*, but the scope of the present disclosure should not be limited in this way.

The audio signals in the surround side audio channels 222 may be processed 508 so that the surround side audio channels 222 are produced in speaker channels 230*a-b* and/or headphone channels 234*a-b*. The surround side audio channels 222 may be partially produced in speaker channels 230*a-b* and partially produced in headphone channels 234*a-b*, but the scope of the present disclosure should not be limited in this way.

The speaker channels 230*a-b* may be provided 510 for output via left and right stereo speakers 206*a-b*. The headphone channels 234*a-b* may be provided 512 for output via headphones 204.

Figure 6:
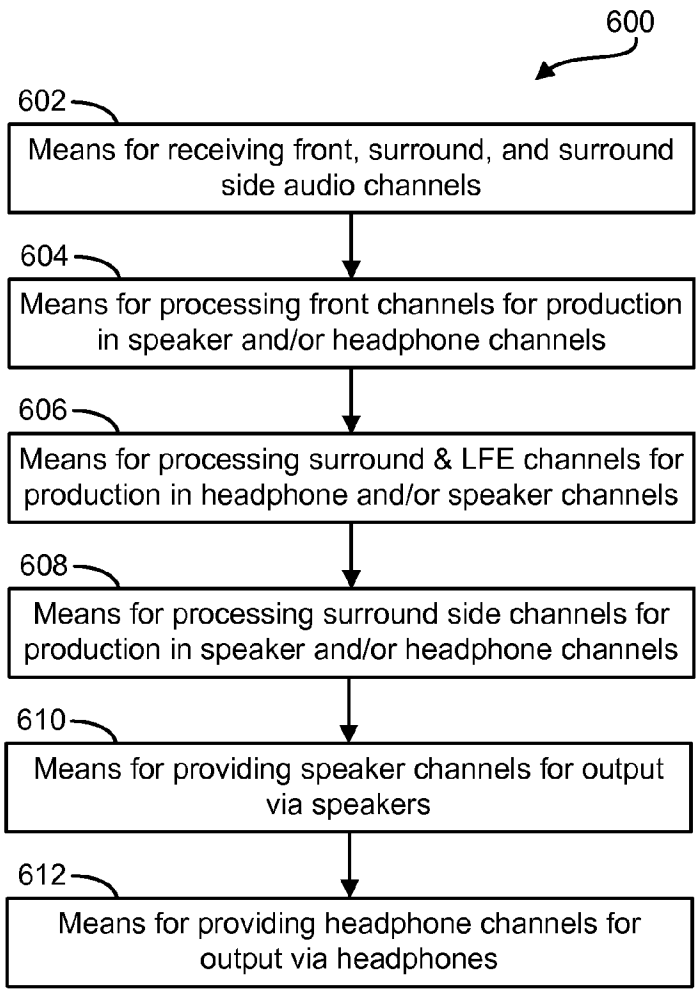
FIG. 6 illustrates means-plus-function blocks corresponding to the method shown in FIG. 5.

The method 500 of FIG. 5 described above may be performed by various hardware and/or software component (s) and/or module(s) corresponding to the means-plus-function blocks 600 illustrated in FIG. 6. In other words, blocks 502 through 512 illustrated in FIG. 5 correspond to means-plus-function blocks 602 through 612 illustrated in FIG. 6.

Figure 7:
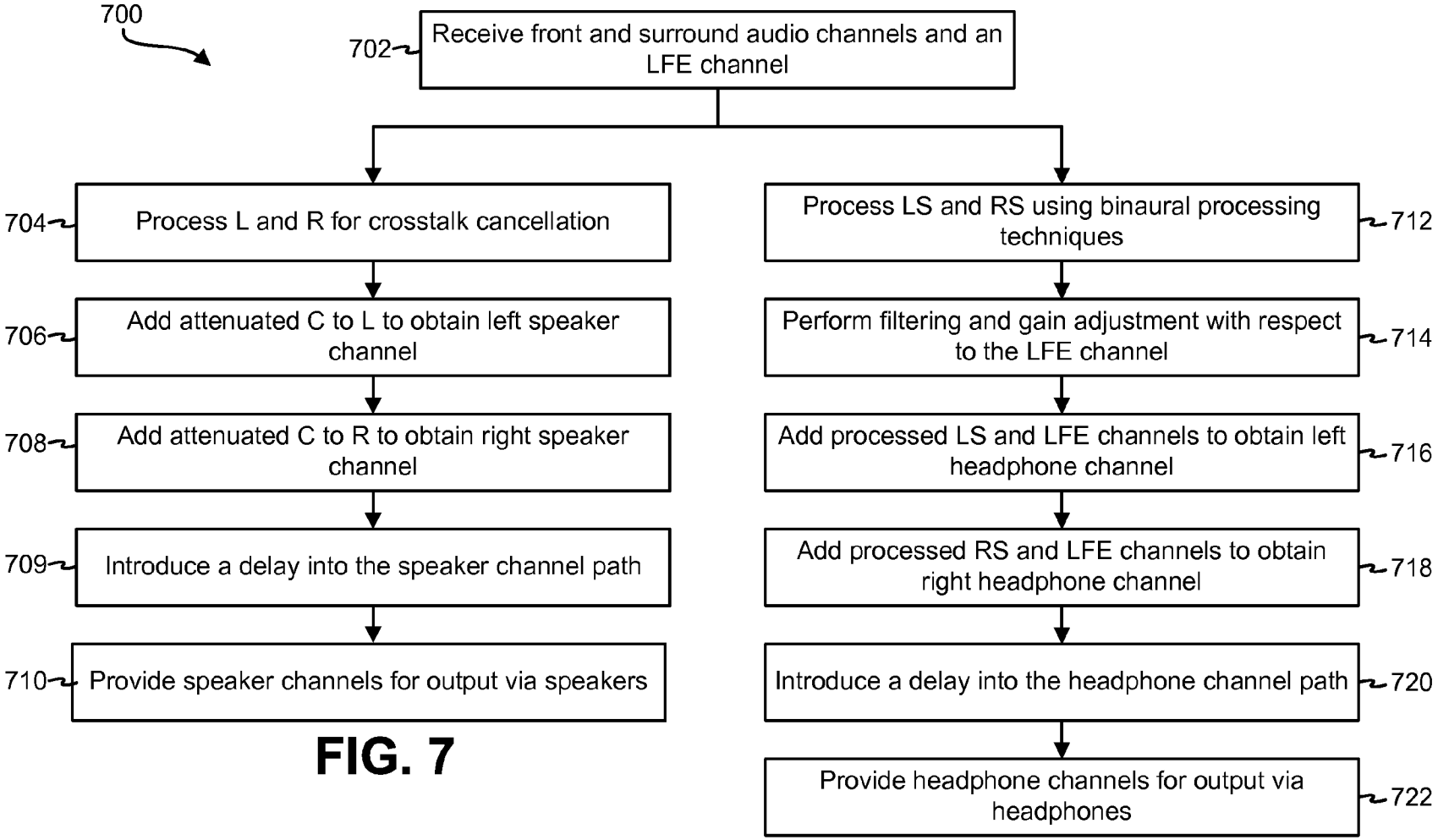
FIG. 7 illustrates another method for providing surround sound using speakers and headphones.

FIG. 7 illustrates another method 700 for providing surround sound using speakers 306 and headphones 304. The depicted method 700 may be used to implement a 5.1 surround sound configuration. In accordance with the method 700, front audio channels 318, surround audio channels 320, and a low frequency effects channel 338 may be received 702 from a decoder 314.

The audio signals in the left audio channel 318*a* and the right audio channel 318*b* may be processed 704 for crosstalk cancellation. An attenuated center audio channel 318*c* may be added 706 to the processed left audio channel 318*a* to obtain a left speaker channel 330*a*. The attenuated center audio channel 318*c* may be added 708 to the processed right audio channel 318*b* to obtain a right speaker channel 330*b*. A delay may be introduced 709 into the speakerphone channel path in order to compensate a transmissional delay between a speaker channel processing module and the left and right headphone channels 334 *a-b*. The speaker channels 330*a-b* may be provided 710 for output via left and right stereo speakers 306*a-b*.

The audio signals in the left surround channel 320*a* and the right surround channel 320*b* may be processed 712 using binaural processing techniques. Filtering, gain adjustment, and possibly other adjustments may be performed 714 with respect to the low frequency effects channel 338.

The processed left surround channel 320*a* may be added 716 to the processed low frequency effects channel 338 to obtain a left headphone channel 334*a*. The processed right surround channel 320*b* may be added 718 to the processed low frequency effects channel 338 to obtain a right headphone channel 334*b*.

A delay may be introduced 720 into the headphone channel path in order to compensate for an acoustic delay from the stereo speakers 306*a-b* to the ears of the listener 302, and/or for the transmission delay (e.g., bluetooth, wireless audio, etc.) from a front processing module to the stereo speakers 306*a-b*. The headphone channels 334*a-b* may then be provided 722 for output via headphones 304.

Figure 8:
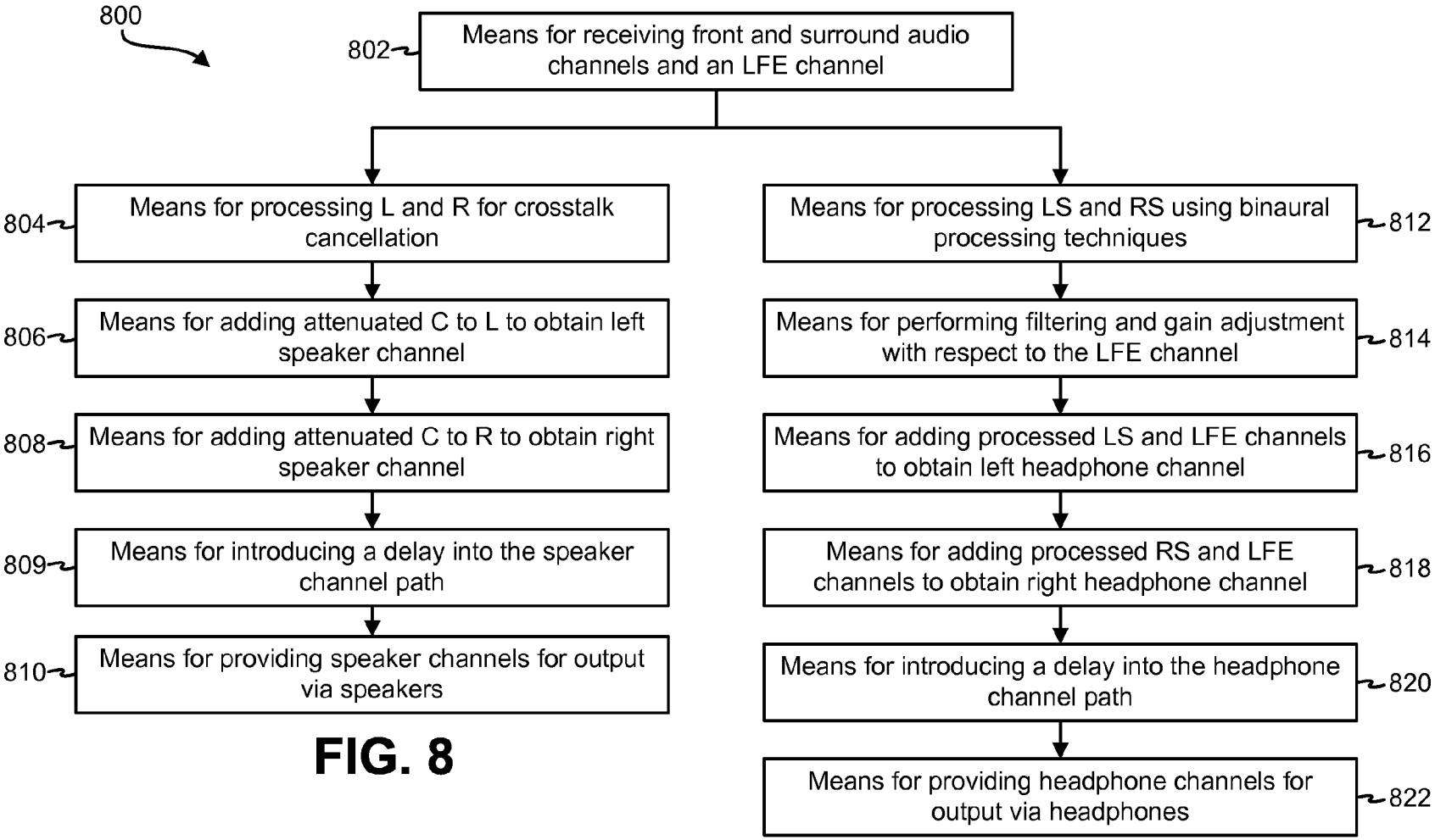
FIG. 8 illustrates means-plus-function blocks corresponding to the method shown in FIG. 7.

The method 700 of FIG. 7 described above may be performed by various hardware and/or software component (s) and/or module(s) corresponding to the means-plus-function blocks 800 illustrated in FIG. 8. In other words, blocks 702 through 722 illustrated in FIG. 7 correspond to means-plus-function blocks 802 through 822 illustrated in FIG. 8.

Figure 9:
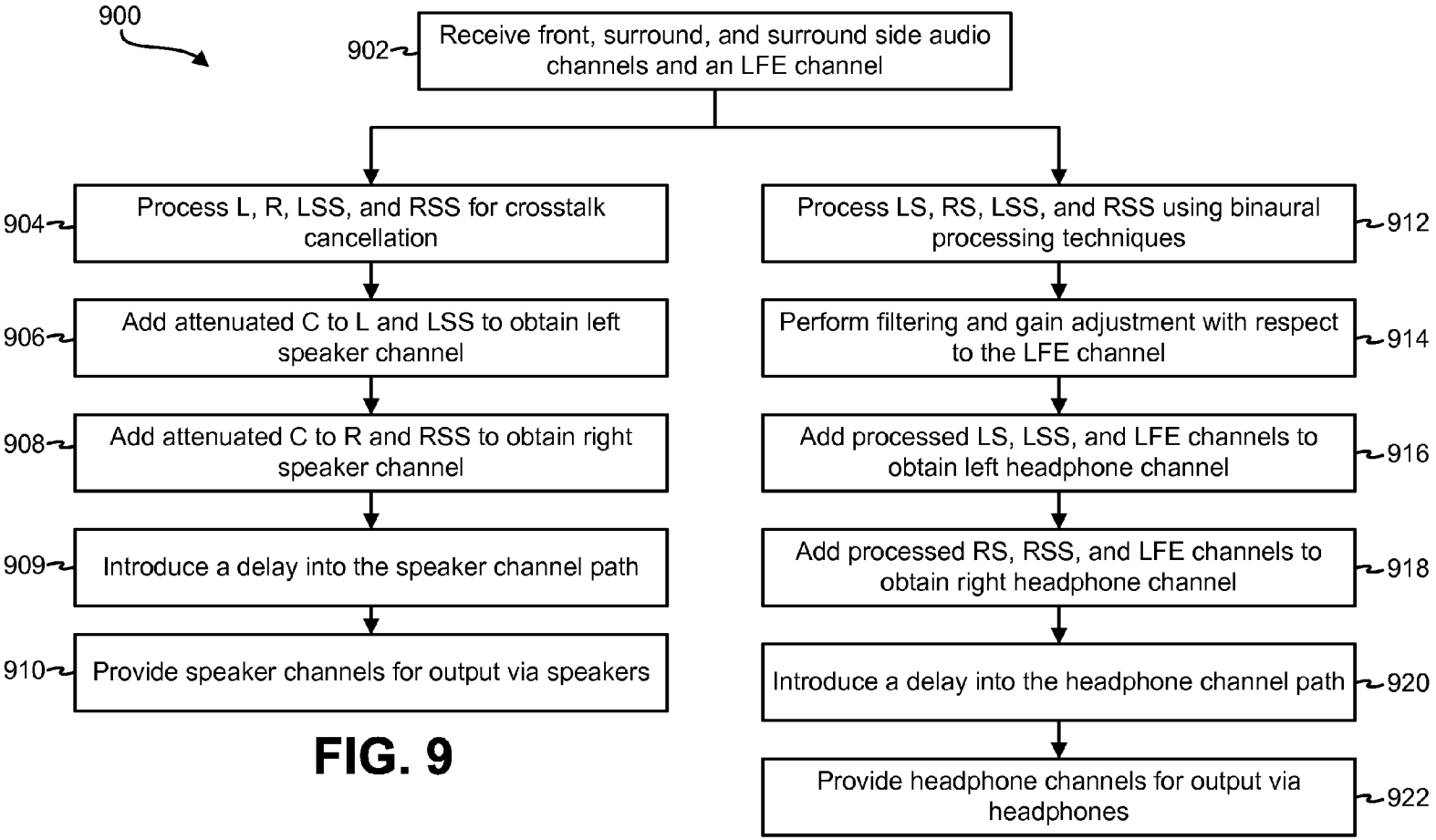
FIG. 9 illustrates another method for providing surround sound using speakers and headphones.

FIG. 9 illustrates another method 900 for providing surround sound using speakers 406 and headphones 404. The depicted method 900 may be used to implement a 7.1 surround sound configuration. In accordance with the method 900, front audio channels 418, surround audio channels 420, surround side audio channels 422, and a low frequency effects channel 438 may be received 902 from a decoder 414.

The audio signals in the left audio channel 418*a* and the right audio channel 418*b* may be processed 904 for crosstalk cancellation. In addition, the audio signals in the left surround side audio channel 422*a* and the right surround side audio channel 422*b* may be processed 904 for crosstalk cancellation.

An attenuated center audio channel 418*c* may be added 906 to the processed left audio channel 418*a* and the processed left surround side audio channel 422*a* to obtain a left speaker channel 430*a*. The attenuated center audio channel 418*c* may be added 908 to the processed right audio channel 418*b* and the processed right surround side audio channel 422*b* to obtain a right speaker channel 430*b*. The speaker channels 430*a-b* may be provided 910 for output via left and right stereo speakers 406*a-b*.

The audio signals in the left surround audio channel 420*a*, the right surround audio channel 420*b*, the left surround side audio channel 422*a*, and the right surround side audio channel 422*b* may be processed 912 using binaural processing techniques. Filtering, gain adjustment, and possibly other adjustments may be performed 914 with respect to the low frequency effects channel 438.

The processed left surround channel 420*a*, the processed left surround side audio channel 422*a*, and the processed low frequency effects channel 438 may be added 916 together to obtain a left headphone channel 434*a*. The processed right surround channel 420*b*, the processed right surround side audio channel 422*b*, and the processed low frequency effects channel 438 may be added 918 together to obtain a right headphone channel 434*b*.

A delay may be introduced 920 into the headphone channel path in order to compensate for an acoustic delay from the stereo speakers 406*a-b* to the ears of the listener 402. The headphone channels 434*a-b* may then be provided 922 for output via headphones 404.

Figure 10:
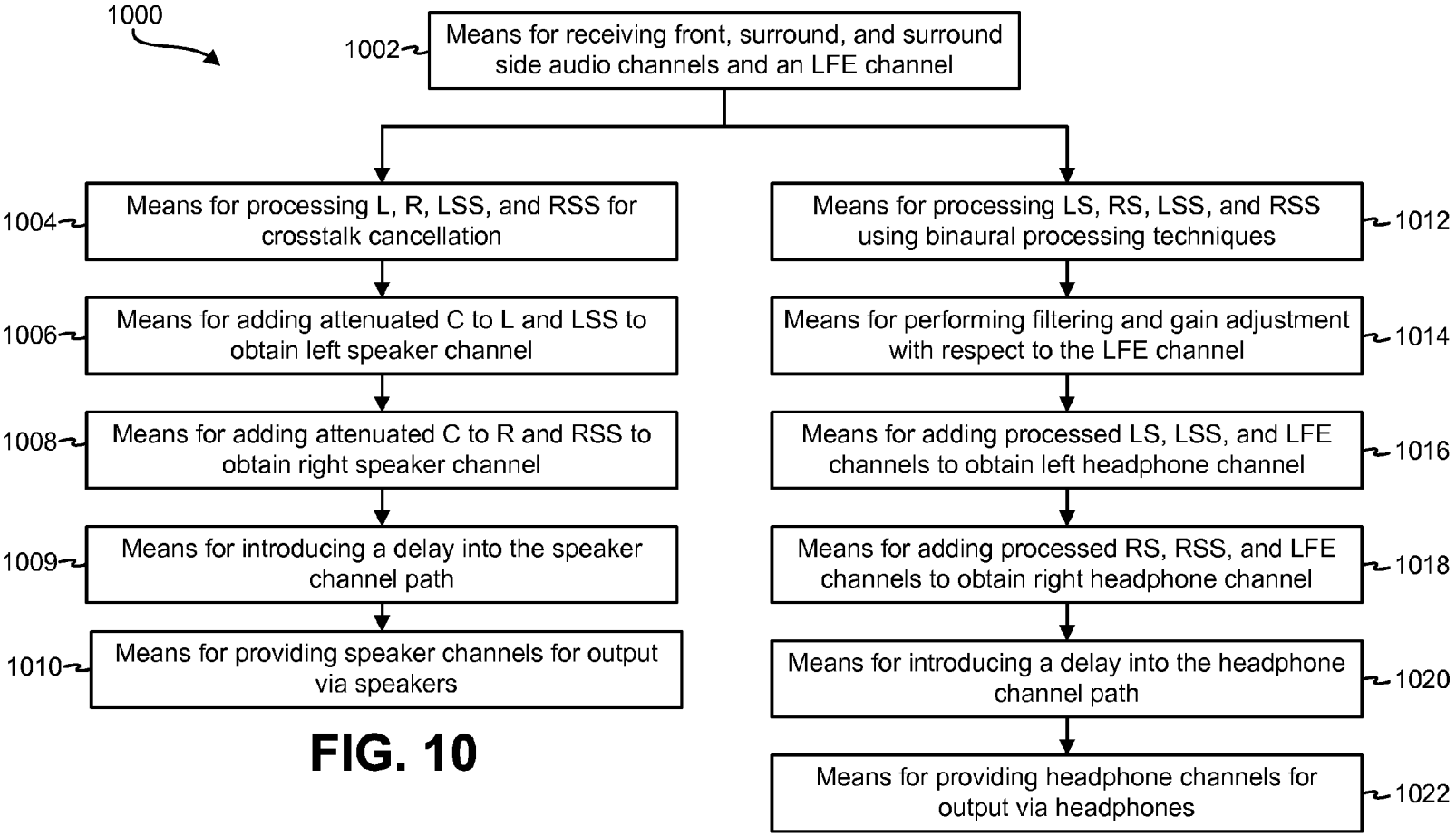
FIG. 10 illustrates means-plus-function blocks corresponding to the method shown in FIG. 9.

The method 900 of FIG. 9 described above may be performed by various hardware and/or software component (s) and/or module(s) corresponding to the means-plus-function blocks 1000 illustrated in FIG. 10. In other words, blocks 902 through 922 illustrated in FIG. 9 correspond to means-plus-function blocks 1002 through 1022 illustrated in FIG. 10.

Figure 11:
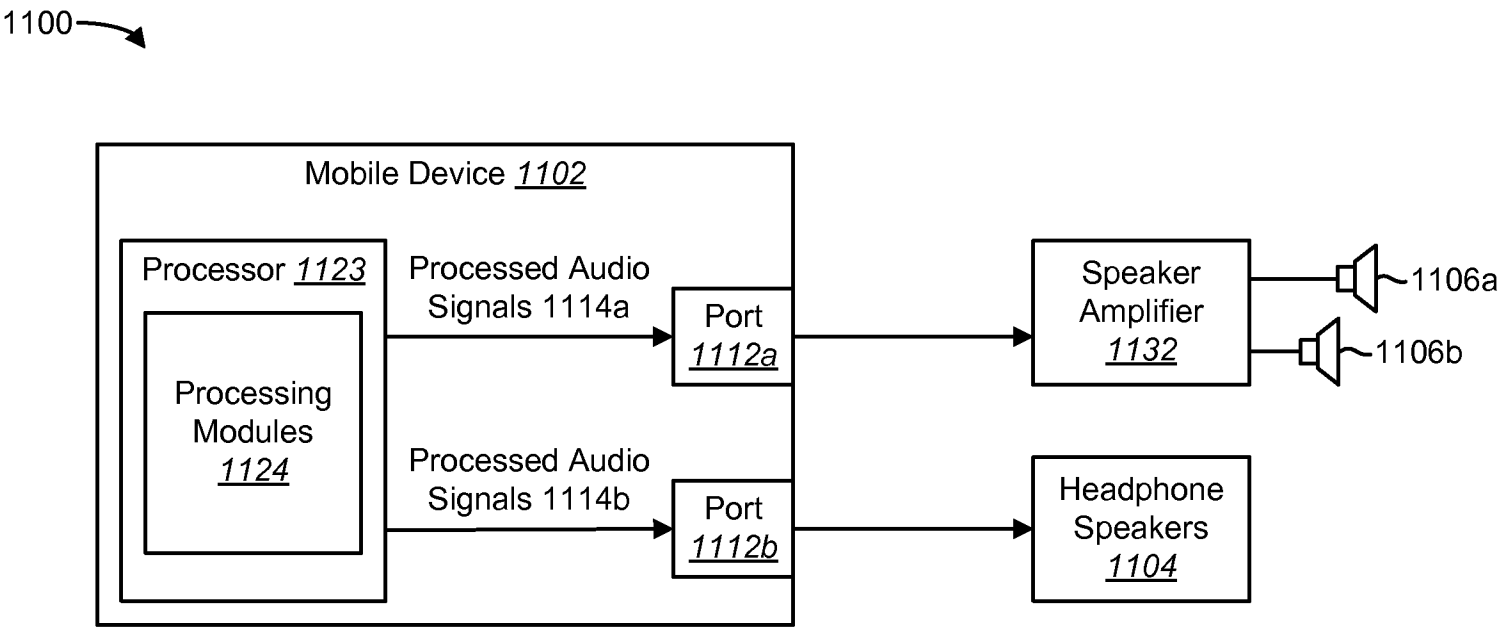
FIG. 11 illustrates a surround sound system that includes a mobile device.

FIG. 11 illustrates a surround sound system 1100 that includes a mobile device 1102. The mobile device 1102 may be configured to provide surround sound using both speakers 1106 and headphones 1104.

The mobile device 1102 includes a processor 1123. The processor 1123 may be configured to implement various processing modules 1124 that generate first and second sets 1114*a*, 1114*b* of processed audio signals. The processing modules 1124 may be configured similarly to the processing modules 324 discussed above in relation to FIG. 3 if the surround sound system 1100 is configured for 5.1 surround sound. The processing modules 1124 may be configured similarly to the processing modules 424 discussed above in relation to FIG. 4 if the surround sound system 1100 is configured for 7.1 surround sound.

The first set 1114*a* of processed audio signals may include audio signals corresponding to left and right stereo speaker channels, such as the left and right speaker channels 330*a-b* shown in FIG. 3 for a 5.1 surround sound system or the left and right speaker channels 430*a-b* shown in FIG. 4 for a 7.1 surround sound system. The second set 1114*b* of processed audio signals may include audio signals corresponding to left and right headphone channels, such as the left and right headphone channels 334*a-b* shown in FIG. 3 for a 5.1 surround sound system or the left and right headphone channels 434*a-b* shown in FIG. 4 for a 7.1 surround sound system.

The mobile device 1102 may also include multiple output ports 1112. A first output port 1112*a* may be adapted to provide the first set 1114*a* of processed audio signals for use in the surround sound system 1100 to first and second speakers 1106*a*, 1106*b*. A second output port 1112*b* may be adapted to provide the second set 1114*b* of processed audio signals for use in the surround sound system 1100 to headphone speakers 1104. Communication between the output port 1112*b* and the headphone speakers 1104 may occur via a wireless communication channel or via a wired connection. If communication occurs via a wireless communication channel, such wireless communication may occur in accordance with the Bluetooth® protocol, an IEEE wireless communication protocol (e.g., 802.11x, 802.15x, 802.16x, etc.), or the like.

The outputs of the ports 1112*a*, 1112*b* may be either digital or analog. If the outputs of the ports 1112*a*, 1112*b* are analog, then the mobile device 1102 may include one or more digital-to-analog converters (DAC).

A speaker amplifier 1132 may be connected to the port 1112*a* that outputs the first set 1114*a* of processed audio signals. The speaker amplifier 1132 may drive the speakers 1106*a*, 1106*b*. Alternatively, the speaker amplifier 1132 may be omitted or it may be located in the mobile device 11102.

Figure 12:
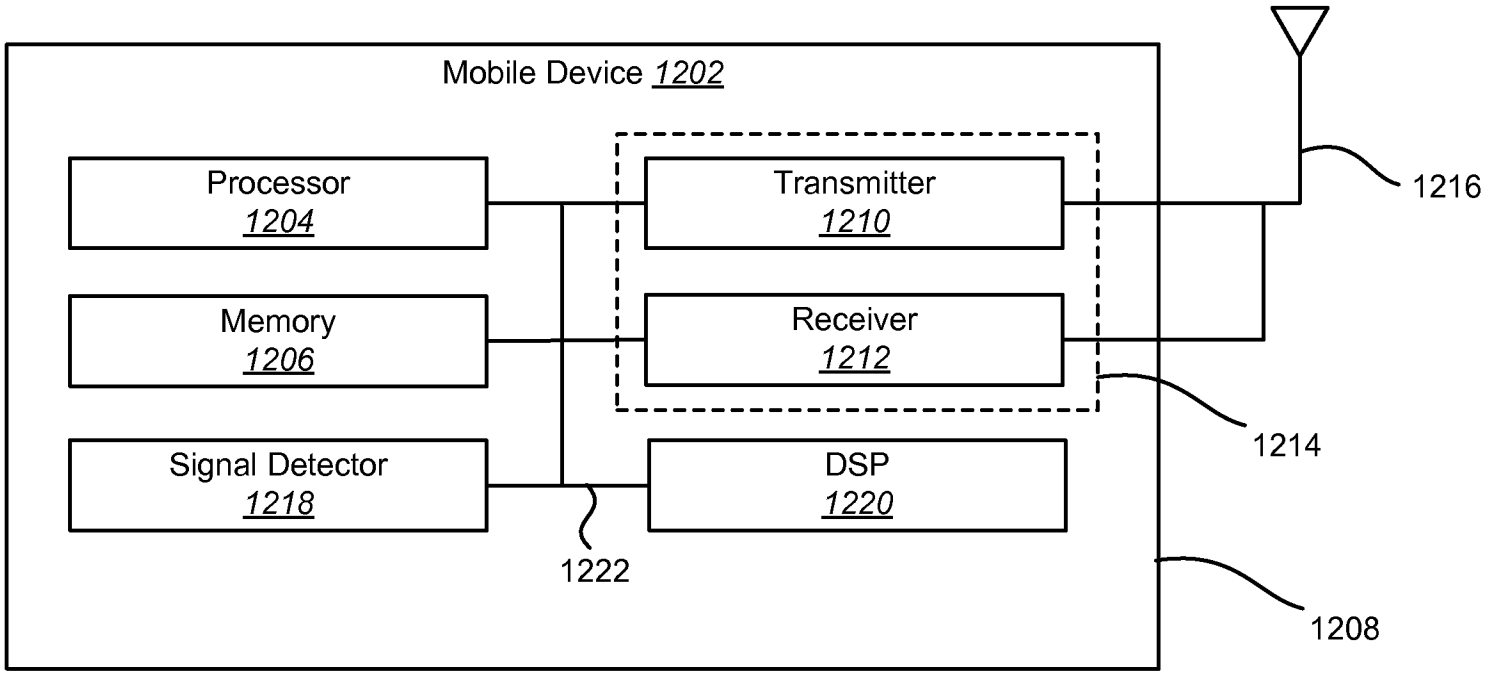
FIG. 12 illustrates various components that may be utilized in a mobile device that may be used to implement the methods described herein.

FIG. 12 illustrates various components that may be utilized in a mobile device 1202. The mobile device 1202 is an example of a device that may be configured to implement the various methods described herein.

The mobile device 1202 may include a processor 1204 which controls operation of the mobile device 1202. The processor 1204 may also be referred to as a central processing unit (CPU). Memory 1206, which may include both read-only memory (ROM) and random access memory (RAM), provides instructions and data to the processor 1204. A portion of the memory 1206 may also include non-volatile random access memory (NVRAM). The processor 1204 typically performs logical and arithmetic operations based on program instructions stored within the memory 1206. The instructions in the memory 1206 may be executable to implement the methods described herein.

The mobile device 1202 may also include a housing 1208 that may include a transmitter 1210 and a receiver 1212 to allow transmission and reception of data between the mobile device 1202 and a remote location. The transmitter 1210 and receiver 1212 may be combined into a transceiver 1214. An antenna 1216 may be attached to the housing 1208 and electrically coupled to the transceiver 1214. The mobile device 1202 may also include (not shown) multiple transmitters, multiple receivers, multiple transceivers and/or multiple antenna.

The mobile device 1202 may also include a signal detector 1218 that may be used to detect and quantify the level of signals received by the transceiver 1214. The signal detector 1218 may detect such signals as total energy, pilot energy per pseudonoise (PN) chips, power spectral density, and other signals. The mobile device 1202 may also include a digital signal processor (DSP) 1220 for use in processing signals.

The various components of the mobile device 1202 may be coupled together by a bus system 1222 which may include a power bus, a control signal bus, and a status signal bus in addition to a data bus. However, for the sake of clarity, the various buses are illustrated in FIG. 12 as the bus system 1222.

The techniques described herein involve the processing of audio signals. The term "processing" is a term of art that has a very broad meaning and interpretation. At a minimum it may mean the storing, moving, multiplying, adding, subtracting, or dividing of audio samples or audio packets by a processor or combination of processors, or software or firmware running on a processor or combination of processors.

In accordance with the present disclosure, a circuit in a mobile device may be adapted to generate a first set and second set of processed audio signals for use in a surround sound system. The same circuit, a different circuit, or a second section of the same or different circuit may be adapted to provide the first set of processed audio signals for use in the surround sound system to at least two speakers. The second section may advantageously be coupled to the first section, or it may be embodied in the same circuit as the first section. In addition, the same circuit, a different circuit, or a third section of the same or different circuit may be adapted to provide the second set of processed audio signals for use in the surround sound system to headphone speakers. The third section may advantageously be coupled to the first and second sections, or it may be embodied in the same circuit as the first and second sections.

As used herein, the term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The various illustrative logical blocks, modules and circuits described in connection with the present disclosure may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described in connection with the present disclosure may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code segments, among different programs and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in software, the functions may be stored as one or more instructions on a computer-readable medium. A computer-readable medium may be any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

Further, it should be appreciated that modules and/or other appropriate means for performing the methods and techniques described herein, such as those illustrated by FIGS. 5-10, can be downloaded and/or otherwise obtained by a mobile device and/or base station as applicable. For example, such a device can be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a mobile device and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A mobile device comprising:

at least one processor in the mobile device configured to generate a first set and second set of processed audio signals for use in a surround sound system, wherein the first set of processed audio signals are audio signals designated for at least two speakers located in front of a user;

at least one output adapted to provide the first set of processed audio signals for use in the surround sound system to the two speakers, thereby producing a third virtualized speaker; and an output adapted to provide the second set of processed audio signals for use in the surround sound system to headphone speakers, wherein the mobile device is configured to generate the first set of processed audio signals by processing a first set of audio channels and to generate the second set of processed audio signals by processing a second set of audio channels, the first set of audio channels and the second set of audio channels included in multiple audio channels, the multiple audio channels comprising front audio channels, surround audio channels, and a low frequency effects channel, wherein the low frequency effects channel is generated in the second set of processed audio signals.

2. The mobile device of claim 1, wherein the first set of processed audio signals are output from a front channel processing module.

3. The mobile device of claim 1, wherein the second set of processed audio signals are output from a surround channel processing module.

4. The mobile device of claim 1, wherein the at least one processor comprises processing modules that are configured to process audio signals in multiple audio channels, the multiple audio channels comprising front audio channels and surround audio channels.

5. The mobile device of claim 4, wherein the processing modules comprise front channel processing modules that are configured to process the audio signals in the front audio channels so that the front audio channels are produced in speaker channels.

6. The mobile device of claim 4, wherein the processing modules comprise surround channel processing modules that are configured to process the audio signals in the surround audio channels so that the surround audio channels are produced in headphone channels.

7. The mobile device of claim 4, wherein the multiple audio channels further comprise a low frequency effects channel, and wherein the processing modules comprise surround channel processing modules that are configured to process the audio signals in the low frequency effects channel so that the low frequency effects channel is produced in headphone channels.

8. The mobile device of claim 4, wherein the front audio channels comprise a left audio channel and a right audio channel, and wherein the processing modules comprise a crosstalk cancellation component that is configured to process the audio signals in the left audio channel and the right audio channel for crosstalk cancellation.

9. The mobile device of claim 4, wherein the processing modules comprise a binaural processing component that is configured to process the audio signals in the surround audio channels using binaural processing techniques.

10. The mobile device of claim 4, wherein the processing modules comprise a delay component that is configured to add a delay to a headphone channel path to compensate for an acoustic delay from the at least two speakers to a user's ears.

11. The mobile device of claim 1, further comprising digital-to-analog converters that perform digital-to-analog conversion for both speaker channels and headphone channels.

12. The mobile device of claim 1, further comprising at least one digital-to-analog converter that performs digital-to-analog conversion for the first set of processed audio signals, wherein the second set of processed audio signals are provided as analog data to a headset, and wherein digital-to-analog conversion for the second set of processed audio signals is performed by the headset.

13. The mobile device of claim 12, wherein there is a wireless link between the mobile device and the headset.

14. The mobile device of claim 13, wherein communication between the mobile device and the headset occurs in accordance with a Bluetooth® protocol.

15. The mobile device of claim 13, wherein communication between the mobile device and the headset occurs in accordance with an Institute of Electrical and Electronics Engineers wireless communication protocol.

16. The mobile device of claim 1, wherein the first set of processed audio signals comprise a left audio channel and a right audio channel, and wherein processing the audio signals in the multiple audio channels comprises processing the audio signals in the left audio channel and the right audio channel for crosstalk cancellation.

17. A method in a mobile device for providing surround sound using speakers and headphones, comprising:

producing a first set and second set of processed audio signals in the mobile device for use in a surround sound system, wherein the first set of processed audio signals are audio signals designated for at least two speakers located in front of a user;

having the two speakers play the first set of processed audio signals for use in the surround sound system, thereby producing a third virtualized speaker; and having headphones play the second set of processed audio signals for use in the surround sound system, wherein producing the first set of processed audio signals comprises processing a first set of audio channels and producing the second set of processed audio signals comprises processing a second set of audio channels, the first set of audio channels and the second set of audio channels being included in multiple audio channels, the multiple audio channels comprising front audio channels, surround audio channels, and a low frequency effects channel, wherein the low frequency effects channel is produced in the second set of processed audio signals.

18. The method of claim 17, wherein the at least two speakers are located in front of a user.

19. The method of claim 17, wherein the first set of processed audio signals are output from a front channel processing module.

20. The method of claim 17, wherein the second set of processed audio signals are output from a surround channel processing module.

21. The method of claim 17, wherein producing the first set and the second set of processed audio signals comprises processing audio signals in multiple audio channels, the multiple audio channels comprising front audio channels, surround audio channels, and a low frequency effects channel.

22. The method of claim 21, wherein processing the audio signals in the multiple audio channels comprises:

processing the audio signals in the front audio channels so that the front audio channels are produced in speaker channels;

processing the audio signals in the surround audio channels so that the surround audio channels are produced in headphone channels; and processing the audio signals in the low frequency effects channel so that the low frequency effects channel is produced in the headphone channels.

23. The method of claim 17, wherein the first set of processed audio signals comprise a left audio channel and a right audio channel, and wherein processing the audio signals in the multiple audio channels comprises processing the audio signals in the left audio channel and the right audio channel for crosstalk cancellation.

24. A mobile device comprising:

means for generating a first set and second set of processed audio signals for use in a surround sound system, wherein the first set of processed audio signals are audio signals designated for at least two speakers located in front of a user;

means for providing the first set of processed audio signals for use in the surround sound system to the two speakers, thereby producing a third virtualized speaker; and means for providing the second set of processed audio signals for use in the surround sound system to headphone speakers, wherein the means for generating the first set and the second set of processed audio signals is configured to generate the first set of processed audio signals by processing the first set of audio signals in multiple audio channels and to generate the second set of processed audio signal by processing a second set of audio signals in the multiple audio channels, the multiple audio channels comprising front audio channels, surround audio channels, and a low frequency effects channel, wherein the means for providing the second set of processed audio signals is configured to provide the low frequency effects channel.

25. The mobile device of claim 24, wherein the first set of processed audio signals are audio signals designated for the at least two speakers located in front of a user.

26. The mobile device of claim 24, wherein the first set of processed audio signals are output from a front channel processing module.

27. The mobile device of claim 24, wherein the second set of processed audio signals are output from a surround channel processing module.

28. The mobile device of claim 24, wherein the means for generating the first set and the second set of processed audio signals comprises means for processing audio signals in multiple audio channels, the multiple audio channels comprising front audio channels, surround audio channels, and the low frequency effects channel.

29. The mobile device of claim 28, wherein the means for processing the audio signals in the multiple audio channels comprises:

means for processing the audio signals in the front audio channels so that the front audio channels are produced in speaker channels;

means for processing the audio signals in the surround audio channels so that the surround audio channels are produced in headphone channels; and means for processing the audio signals in the low frequency effects channel so that the low frequency effects channel is produced in the headphone channels.

30. The mobile device of claim 24, wherein the first set of processed audio signals comprise a left audio channel and a right audio channel, and wherein processing the audio signals in the multiple audio channels comprises processing the audio signals in the left audio channel and the right audio channel for crosstalk cancellation.

31. A non-transitory computer-readable medium comprising instructions for providing surround sound in a mobile device using speakers and headphones, which when executed by a processor in the mobile device to cause the processor to:

generate a first set and second set of processed audio signals for use in a surround sound system, wherein the first set of processed audio signals are audio signals designated for at least two speakers located in front of a user;

provide the first set of processed audio signals for use in the surround sound system to the two speakers, thereby producing a third virtualized speaker; and provide the second set of processed audio signals for use in the surround sound system to headphone speakers, wherein generating the first set of processed audio signals comprises processing a first set of audio signals in multiple audio channels and generating the second set of processed audio signals comprises processing a second set of audio signals in the multiple audio channels, the multiple audio channels comprising front audio channels, surround audio channels, and a low frequency effects channel, wherein the low frequency effects channel is produced in the second set of processed audio signals.

32. The computer-readable medium of claim 31, wherein the first set of processed audio signals are audio signals designated for the at least two speakers located in front of a user.

33. The computer-readable medium of claim 31, wherein the first set of processed audio signals are output from a front channel processing module.

34. The computer-readable medium of claim 31, wherein the second set of processed audio signals are output from a surround channel processing module.

35. The computer-readable medium of claim 31, wherein generating the first set and the second set of processed audio signals comprises processing audio signals in multiple audio channels, the multiple audio channels comprising front audio channels, surround audio channels, and a low frequency effects channel.

36. The computer-readable medium of claim 35, wherein processing the audio signals in the multiple audio channels comprises:

processing the audio signals in the front audio channels so that the front audio channels are produced in speaker channels;

processing the audio signals in the surround audio channels so that the surround audio channels are produced in headphone channels; and processing the audio signals in the low frequency effects channel so that the low frequency effects channel is produced in the headphone channels.

37. The transitory computer-readable medium of claim 31, wherein the first set of processed audio signals comprise a left audio channel and a right audio channel, and wherein processing the audio signals in the multiple audio channels comprises processing the audio signals in the left audio channel and the right audio channel for crosstalk cancellation.

38. An integrated circuit in a mobile device for providing surround sound using speakers and headphones, the integrated circuit comprising:

a first section configured to generate a first set and second set of processed audio signals for use in a surround sound system, wherein the first set of processed audio signals are audio signals designated for at least two speakers located in front of a user;

a second section configured to provide the first set of processed audio signals for use in the surround sound system to the two speakers thereby producing a third virtualized speaker; and a third section configured to provide the second set of processed audio signals for use in the surround sound system to headphone speakers, wherein the first section comprises a first circuit configured to process a first set of audio signals in multiple audio channels and a second circuit configured to process a second set of audio signals in the multiple audio channels, the multiple audio channels comprising front audio channels, surround audio channels, and a low frequency effects channel, wherein the low frequency effects channel is produced in the second set of processed audio signals.

39. The integrated circuit of claim 38, wherein the first set of processed audio signals are audio signals designated for the at least two speakers located in front of a user.

40. The integrated circuit of claim 38, further comprising a front channel processing module configured to output the first set of processed audio signals.

41. The integrated circuit of claim 38, further comprising a surround channel processing module configured to output the second set of processed audio signals.

42. The integrated circuit of claim 38, wherein the first section comprises a third circuit configured to process audio signals in multiple audio channels, the multiple audio channels comprising front audio channels, surround audio channels, and a low frequency effects channel.

43. The integrated circuit of claim 42, the third circuit comprises:

means for processing the audio signals in the front audio channels so that the front audio channels are produced in speaker channels;

means for processing the audio signals in the surround audio channels so that the surround audio channels are produced in headphone channels; and means for processing the audio signals in the low frequency effects channel so that the low frequency effects channel is produced in the headphone channels.

44. The integrated circuit of claim 38, wherein the first set of processed audio signals comprise a left audio channel and a right audio channel, and wherein the first section comprises means for processing the audio signals in the left audio channel and the right audio channel for crosstalk cancellation.

* * * * *